US011584488B2

(12) United States Patent
Garceau

(10) Patent No.: US 11,584,488 B2
(45) Date of Patent: Feb. 21, 2023

(54) PONTOON OR HULL ADJUSTMENT SYSTEM

(71) Applicant: NORCO INDUSTRIES, INC., Compton, CA (US)

(72) Inventor: Bernard F. Garceau, Vandalia, MI (US)

(73) Assignee: NORCO INDUSTRIES, INC., Compton, CA (US)

( * ) Notice: Subject to any disclaimer, the term of this patent is extended or adjusted under 35 U.S.C. 154(b) by 0 days.

(21) Appl. No.: 17/494,330

(22) Filed: Oct. 5, 2021

(65) Prior Publication Data

US 2022/0111938 A1 Apr. 14, 2022

Related U.S. Application Data

(60) Provisional application No. 63/246,893, filed on Sep. 22, 2021, provisional application No. 63/198,305, filed on Oct. 9, 2020.

(51) Int. Cl.

| | |
|---|---|
| ***B63B 39/02*** | (2006.01) |
| ***B63B 35/38*** | (2006.01) |
| ***B63B 39/14*** | (2006.01) |

(52) U.S. Cl.

CPC ..... *B63B 39/02* (2013.01); *B63B 35/38* (2013.01); *B63B 39/14* (2013.01)

(58) Field of Classification Search

CPC .... B63B 1/02; B63B 1/10; B63B 1/12; B63B 1/121; B63B 35/34; B63B 35/38; B63B 39/00; B63B 39/02; B63B 39/14

(Continued)

(56) References Cited

U.S. PATENT DOCUMENTS 2,347,959 A * 5/1944 Moore ..... B63B 1/22 114/18

3,736,898 A 6/1973 Yamura (Continued)

FOREIGN PATENT DOCUMENTS

WO 2013055300 A1 4/2013

OTHER PUBLICATIONS

Wikipedia, Hydrofoil, https://en.wikipedia.org/wiki/Hydrofoil, Jan. 5, 2022, 14 pages.

(Continued)

*Primary Examiner* — Daniel V Venne

(74) *Attorney, Agent, or Firm* — Vorys, Sater, Seymour and Pease LLP; Mark A. Watkins

(57) ABSTRACT

A boat may have a deck and a plurality of pontoons or hulls supporting the deck of the boat. The boat may include a starboard side pontoon, a port side pontoon, and possibly a middle pontoon. A positioning assembly may be provided with one or more of the foregoing pontoons. Each of the positioning assemblies may comprise a link assembly coupling the deck to the starboard side pontoon, wherein the link assembly is configured to permit pivoting of the starboard side pontoon relative to the deck from a retracted position, where the starboard side pontoon is proximate to an underside of the deck, to an extended position, where the starboard side pontoon is moved further from the underside, and an actuator provided to position the starboard side pontoon between the retracted position and the extended position. The boat may further include a leveling control system having a controller and a level sensor configured to detect an attitude of the deck, the controller in communication with the actuators and cause actuation of either or both of the actuators to extend or retract the port side pontoon (Continued)

and/or the starboard side pontoon based on data received from the level sensor indicative of the deck attitude.

17 Claims, 25 Drawing Sheets

(58) Field of Classification Search
USPC ... 114/114, 61.1, 61.11, 61.12, 61.13, 61.14, 114/61.15, 61.16
See application file for complete search history.

(56) References Cited

U.S. PATENT DOCUMENTS

| | | | | |
|---|---|---|---|---|
| 4,337,715 | A | 7/1982 | de Pingon | |
| 4,457,248 | A * | 7/1984 | Thurston | B63B 15/0083 114/61.16 |
| 5,143,386 | A | 9/1992 | Uriarte | |
| 5,237,947 | A * | 8/1993 | Manning | B63B 1/285 114/274 |
| 5,408,948 | A | 4/1995 | Arii et al. | |
| 6,050,573 | A | 4/2000 | Kunz | |
| 6,584,385 | B1 | 6/2003 | Ford et al. | |
| 6,885,924 | B2 | 4/2005 | Ford et al. | |
| 7,193,381 | B2 | 3/2007 | Ford et al. | |
| 7,199,534 | B2 | 4/2007 | Ford et al. | |
| 7,208,896 | B2 | 4/2007 | Ford et al. | |
| 7,617,018 | B2 | 11/2009 | Ford et al. | |
| 9,073,605 | B2 * | 7/2015 | Hall | B63B 17/00 |
| 9,233,732 | B2 | 1/2016 | Wilson | |
| 10,501,149 | B1 | 12/2019 | Hall | |
| 11,077,919 | B1 | 8/2021 | Michael et al. | |
| 2008/0022911 | A1 | 1/2008 | Sullivan | |
| 2009/0127531 | A1 | 5/2009 | Bakshi | |
| 2014/0214283 | A1 | 7/2014 | Maurer | |

OTHER PUBLICATIONS

Freescale Semiconductor, Inc.; 6-Axis Xtrinsic Sensor with Integrated Linear Accelerometer and Magnetometer; Data Sheet: Advance Information Document No. FXOS8700CQ, Rev. 1, Jun. 2012; pp. 1-87 US.

Lippert Components, Level Up automatic leveling system. Jul. 24, 2013. 4 pages.

* cited by examiner 110
204
306
308b
212
214
310b
302
304
210
102,104,106

110
310a
214
312
304
302
204
306
308a
210
212
102,104,106

FIG. 7B
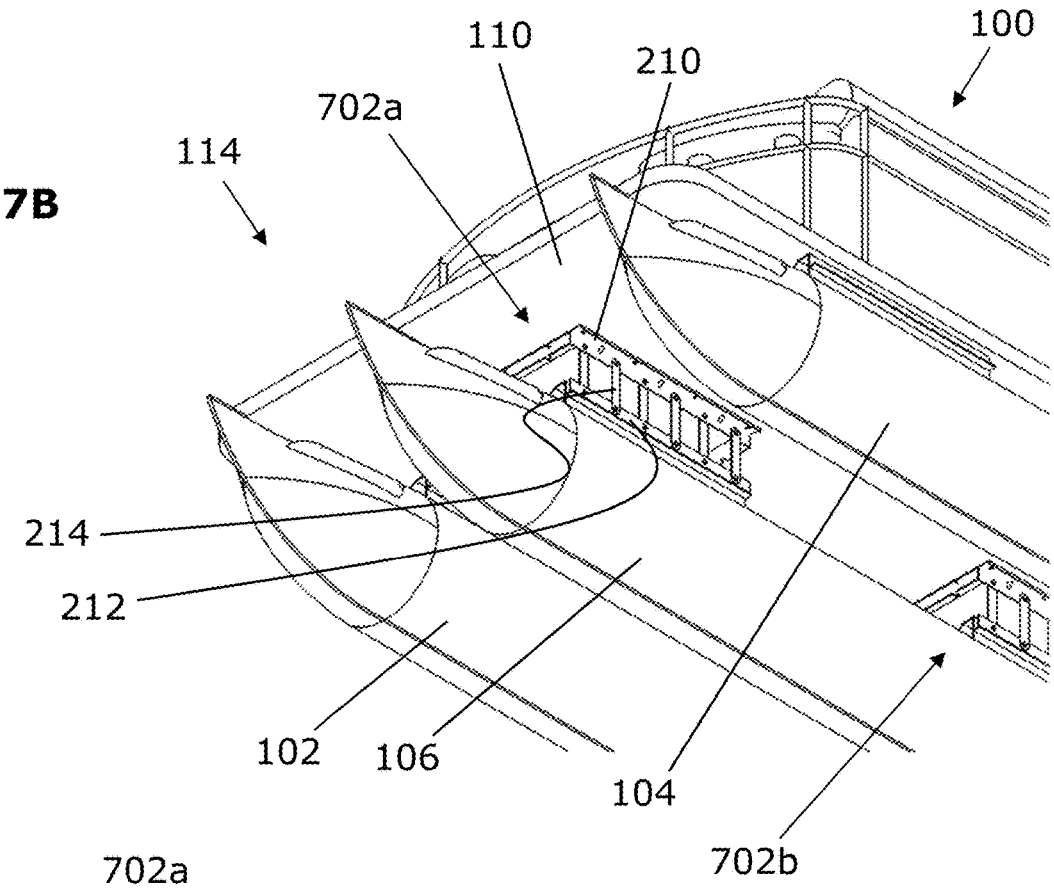
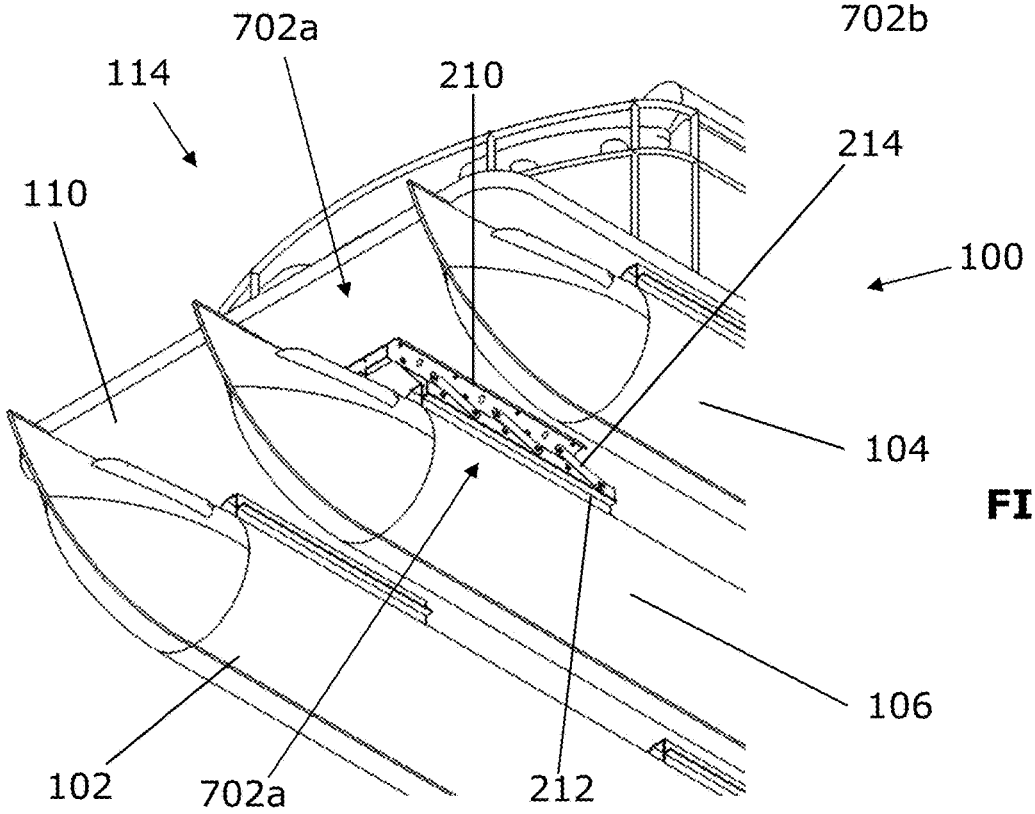
FIG. 7C

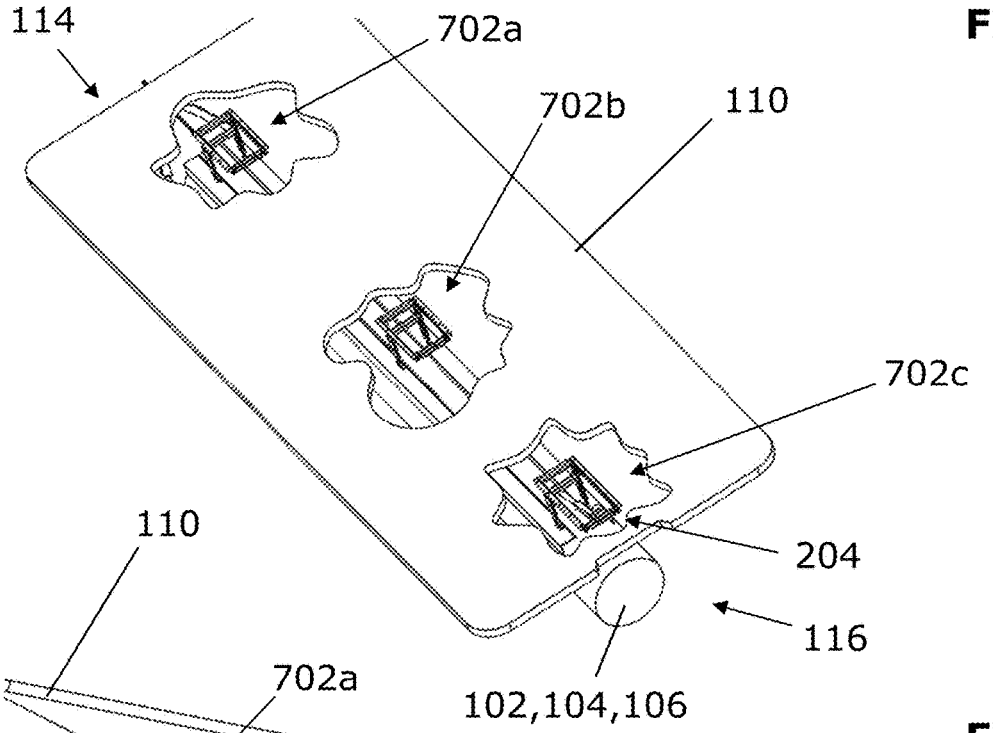
FIG. 8A
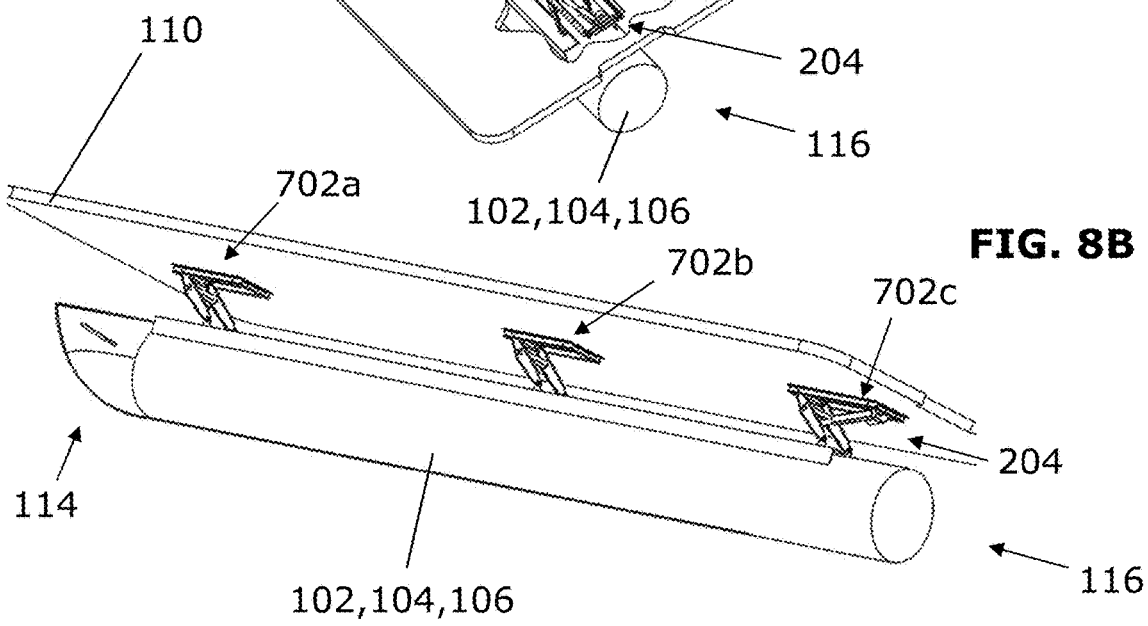
FIG. 8B
FIG. 8C
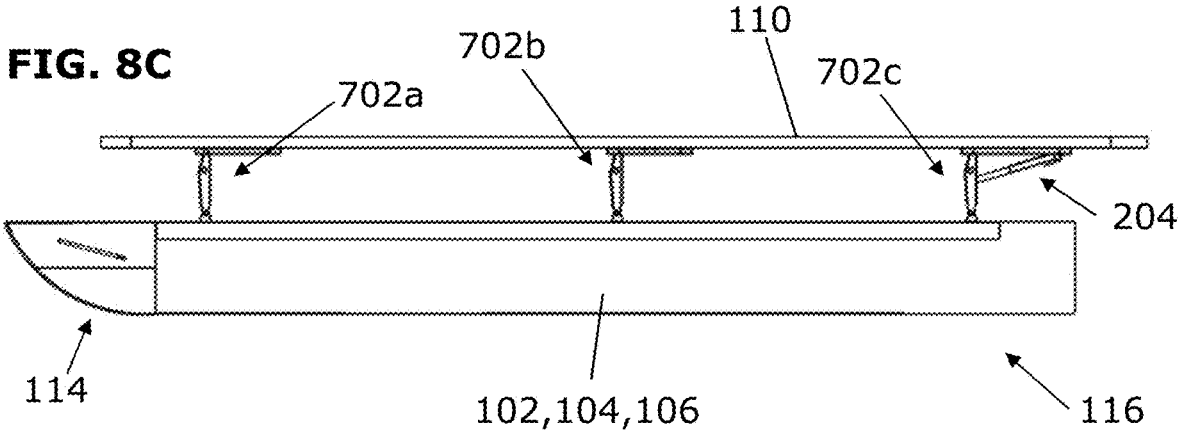

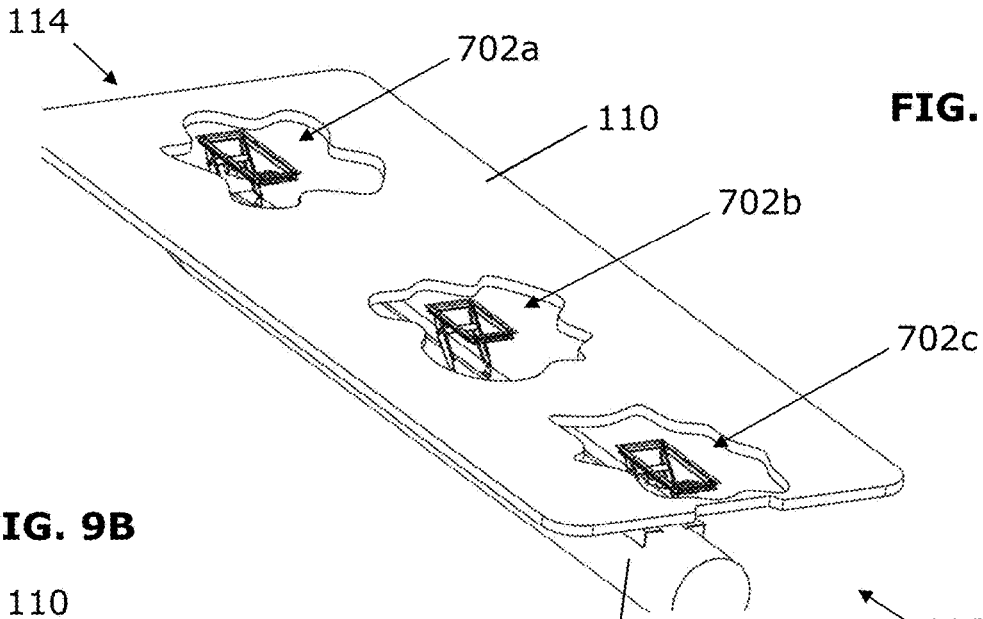
FIG. 9A
FIG. 9B
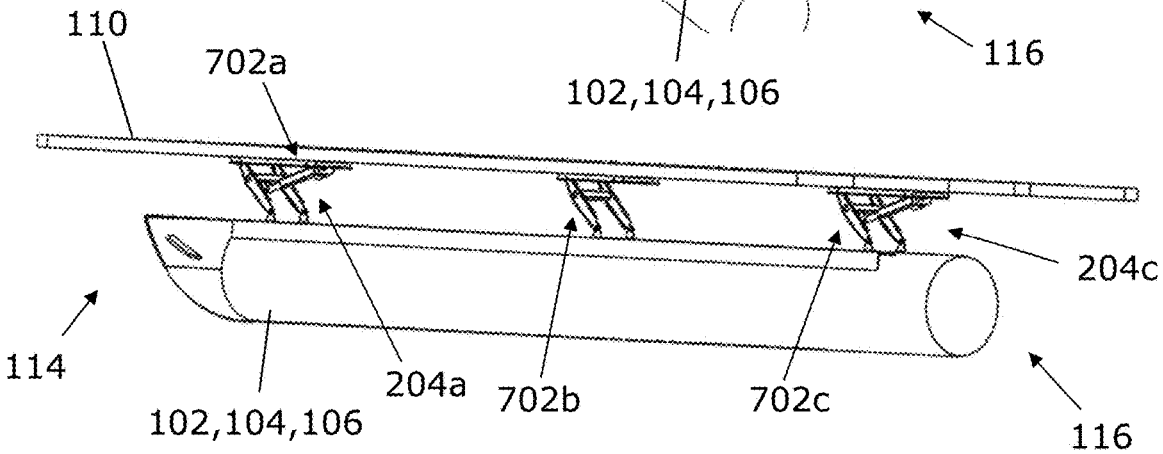
FIG. 9C
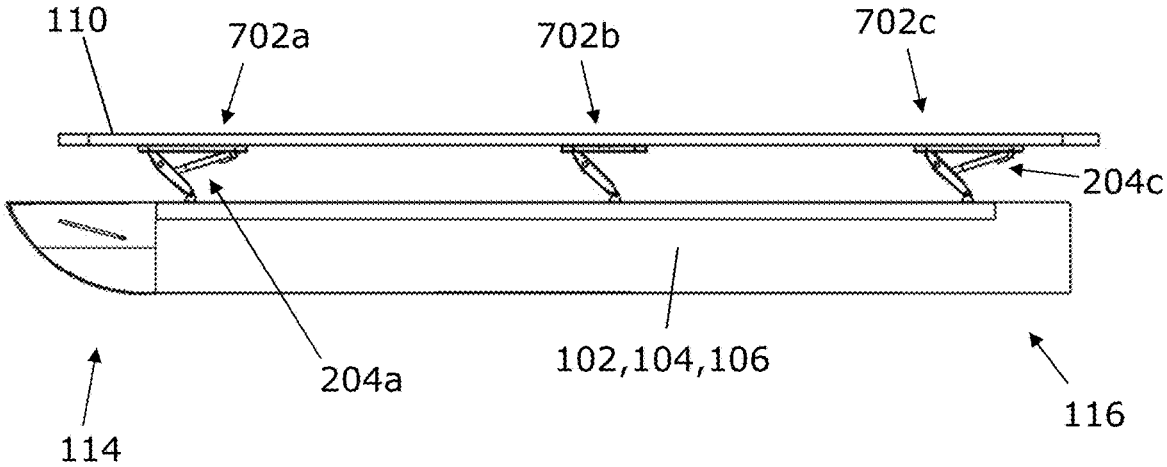

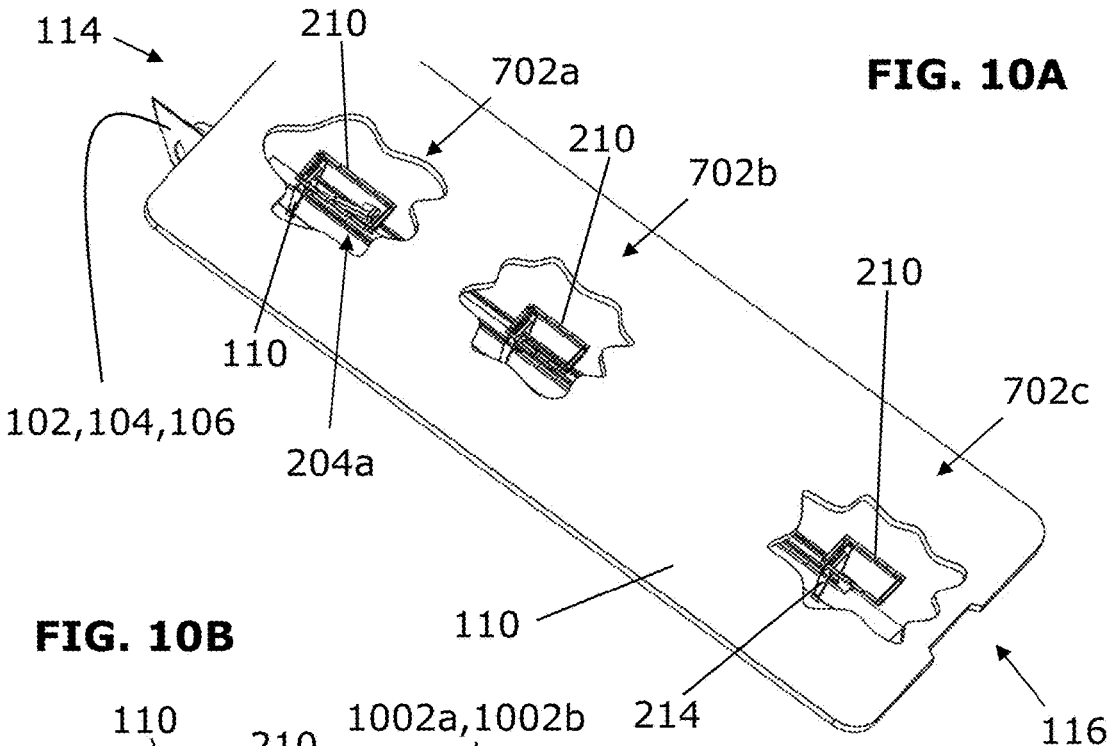
FIG. 10A
FIG. 10B
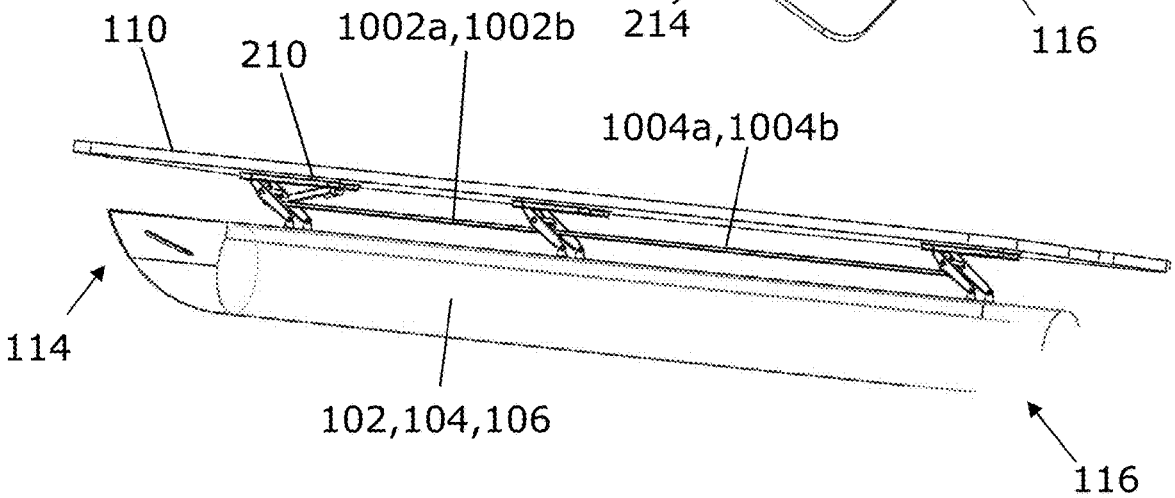
FIG. 10C
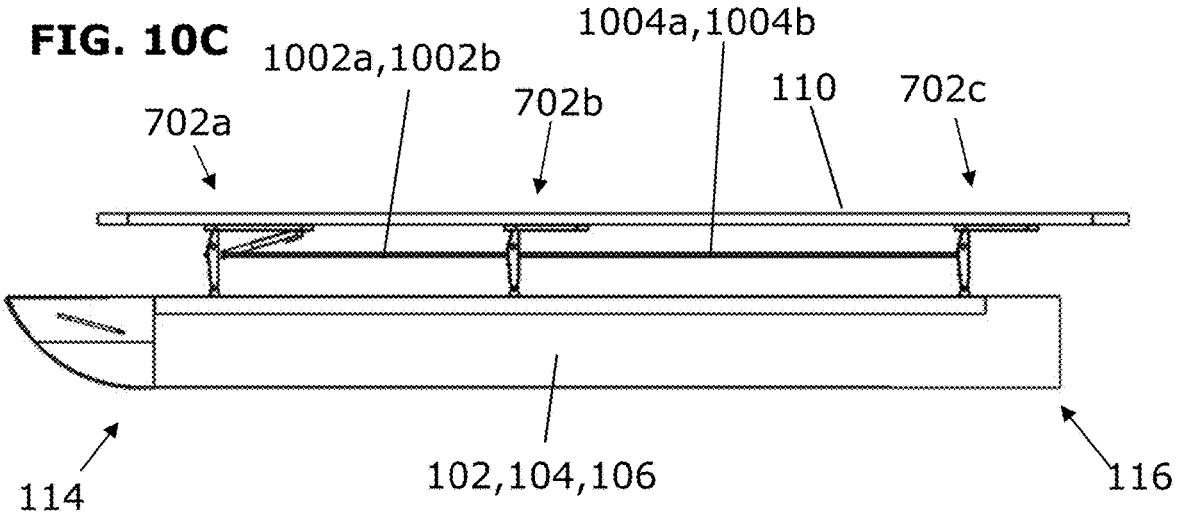

PONTOON OR HULL ADJUSTMENT SYSTEM

CROSS-REFERENCE TO RELATED APPLICATION

This application claims priority to and the benefit of U.S. Provisional Application No. 63/198,305 filed Oct. 9, 2020 and U.S. Provisional Application No. 63/246,893 filed Sep. 22, 2021, both of which are incorporated by reference herein in their entirety.

BACKGROUND

Pontoon boats are a type of multi-hull watercraft that rely on pontoons ("toons") or air cylinders for providing buoyancy. Generally, pontoon boats are of a rectangular shape and have twin lengthwise hulls or pontoons along the longer sides of the boat (i.e., a dual pontoon pontoon boat), and some pontoon boats further include a third, middle lengthwise hull or pontoon positioned in the middle between the two side pontoons. Pontoon boats are less costly to purchase and maintain than performance boats, but are useful and popular for carrying larger groups of passengers. However, when carrying large groups of passengers and/or loads, the weight might not be evenly distributed on the boat's deck, causing it list or tilt to either the port or starboard side, or to trim (or tip) forward or rearward in the water. Not only is such listing or trimming uncomfortable for the passengers riding on the boat, but it may adversely impact performance. Accordingly, a need exists for a system for overcoming these shortcomings.

SUMMARY

Embodiments herein are directed towards a pontoon or hull adjustment mechanism. Embodiments herein are also directed towards leveling systems for pontoon or multihull watercraft.

In accordance with some aspects of the present disclosure, a multi-hull boat, ship, or watercraft is described. A boat may have a deck supported by a port side pontoon and a starboard side pontoon, and the boat may comprise: (i) a starboard side pontoon positioning assembly comprising: a link assembly coupling the deck to the starboard side pontoon, wherein the link assembly is configured to permit movement of the starboard side pontoon relative to the deck from a retracted position, where the starboard side pontoon is proximate to an underside of the deck, to an extended position, where the starboard side pontoon is moved further from the underside, and an actuator provided to position the starboard side pontoon between the retracted position and the extended position; (ii) a port side pontoon positioning assembly comprising: a link assembly coupling the deck to the port side pontoon, wherein the link assembly is configured to permit movement of the port side pontoon relative to the deck from a retracted position, where the port side pontoon is proximate to an underside of the deck, to an extended position, where the port side pontoon is moved further from the underside, and an actuator provided to position the port side pontoon between the retracted position and the extended position; and (iii) a leveling control system having a controller and a level sensor configured to detect an attitude of the deck, the controller in communication with the actuators and cause actuation of either or both of the actuators to extend or retract the port side pontoon and/or the starboard side pontoon based on data received from the level sensor indicative of the deck attitude. In another embodiment, the boat may further include a middle pontoon arranged between the port side pontoon and the starboard side pontoon, and a middle pontoon positioning assembly comprising: a link assembly coupling the deck to the middle pontoon, wherein the link assembly is configured to permit movement of the middle pontoon relative to the deck from a retracted position, where the middle pontoon is proximate to an underside of the deck, to an extended position, where the middle pontoon is moved further from the underside, and an actuator provided to position the middle pontoon between the retracted position and the extended position; and wherein the controller is in communication with the actuator of the middle pontoon positioning assembly and configured to cause actuation of the actuator thereof to extend or retract the middle pontoon based on data received from the level sensor indicative of the deck attitude. In another further embodiment, the controller is configured to adjust position of the port side pontoon and/or the starboard side pontoon to thereby orient the deck in a desired attitude. In another further embodiment, the link assemblies are scissor link assemblies configured to permit vertical extension or retraction of the associated pontoons. In another further embodiment, the link assemblies are scissor link assemblies configured to permit vertical extension or retraction of the associated pontoons. In another further embodiment, the middle pontoon is shorter than the port side pontoon and the starboard side pontoon.

In accordance with some aspects of the present disclosure, a pontoon positioning assembly is described. The pontoon positioning assembly may include at least one pontoon supporting a deck; a link assembly coupling the deck to the at least one pontoon, wherein the link assembly is configured to permit movement of the at least one pontoon relative to the deck from a retracted position, where the at least one proximate to an underside of the deck, to an extended position, where the at least one pontoon is moved further from the underside; and an actuator provided to position the at least one pontoon between the retracted position and the extended position. In another embodiment, the link assembly comprises two or more discrete linkage segments. In another further embodiment, the actuator drives a first of the two or more discrete linkage segments. In another further embodiment, the pontoon positioning assembly further comprises a coupling member connecting the two or more discrete linkage segments together and transmitting power from the first of the two or more discrete linkage segments to one or more remaining discrete linkage segments. In another further embodiment, the actuator comprises two or more actuators, wherein a first of the two or more actuators drives a first of the two or more discrete linkage segments and a second of the two or more actuators drives a second of the two or more discrete linkage segments. In another further embodiment, two or more actuators are electronically synchronized. In another further embodiment, the two or more discrete linkage segments includes a bow end linkage segment, a stern end linkage segment, and a middle linkage segment between the bow end and stern end linkage segment. In another further embodiment, the actuator drives the bow end linkage segment; or the actuator drives the stern end linkage segment; or the actuator comprises two or more actuators, wherein a first of the two or more actuators drives the bow end linkage segment and a second of the two or more actuators drives the stern end linkage segment. In another further embodiment, the actuator is positioned proximate to a stern end of the deck. In another further embodiment, the actuator applies drive force to either a stern end of the linkage assembly or a bow end of the pontoon. In another further embodiment, the actuator causes extension or retraction of the pontoon based on data indicative of an attitude of the deck. In another further embodiment, the data is captured via a sensor configured to monitor the attitude of the deck. In another further embodiment, the sensor transmits the data to a controller, and the controller is configured to cause extension or retraction of the pontoon based on the data. In another further embodiment, the link assembly is a scissor link assembly configured to permit vertical extension or retraction of the associated pontoon. In another further embodiment, the associated pontoon is pivotally attached to the deck at a stern end and the scissor link assembly couples the associated pontoon to the deck at a bow end, such that the associated pontoon may pivot about an axis upon actuation of the actuator. In another further embodiment, the pontoon positioning assembly further comprises a switch configured to control activation of the actuator, wherein activation of the switch extends or retracts the at least one pontoon associated with the actuator.

In accordance with some aspects of the present disclosure, a leveling control system for adjusting an attitude of a boat deck supported by at least a starboard side pontoon and a port side pontoon is described. The leveling system may comprise a starboard side actuator operable to move the starboard side pontoon relative to the deck from a retracted position, where the starboard side pontoon is proximate to an underside of the deck, to an extended position, where the starboard side pontoon is moved further from the underside; a port side actuator operable to move the port side pontoon relative to the deck from a retracted position, where the port side pontoon is proximate to an underside of the deck, to an extended position, where the port side pontoon is moved further from the underside; a level sensor providing readings indicative of the attitude of the boat deck; a control means for activating the starboard side actuator and/or the port side actuator to thereby cause extension or retraction of the starboard side pontoon and/or the port side pontoon, respectively. In another further embodiment, the control mean is a pair of switches, where a first of the pair of switches is configured to activate the port side actuator and thereby extend or retract the port side pontoon, and a second of the pair of switches is configured to activate the starboard side actuator and thereby extend or retract the starboard side pontoon. In another further embodiment, the level sensor is a bubble level or visual level indicator providing visual readings indicative of the attitude. In another further embodiment, the control mean is a controller configured to receive the readings from level sensor and communicate control signals to the starboard side actuator and the port side actuator to extend and retract the starboard side pontoon and the port side pontoon based on the readings to position the deck into a desired attitude. In another further embodiment, the boat deck is further supported by a middle pontoon arranged between the port side pontoon and the starboard side pontoon, the leveling control system further comprising: a middle actuator operable to move the middle pontoon relative to the deck from a retracted position, where the middle pontoon is proximate to an underside of the deck, to an extended position, where the middle pontoon is moved further from the underside, and wherein the control means is configured to activate the middle actuator to thereby cause extension or retraction of the middle pontoon. In another further embodiment, the controller is in communication with the middle actuator and configured to cause actuation thereof to extend or retract the middle pontoon based on data received from the level sensor indicative of the deck attitude. In another further embodiment, the desired attitude is a level attitude as indicated by the level sensor. In another further embodiment, the leveling control system further comprises an actuator operable to adjust vertical positioning of a boat motor, the controller configured to control vertical position of the boat motor relative to the deck based on extension and retraction of the starboard side and port side pontoons.

In accordance with some aspects of the present disclosure, a hull adjustment mechanism for a multi hull boat having a deck, a starboard side hull fixed to the deck, a port side hull fixed to the deck, and a middle hull between the port side and starboard side hulls is described. The hull adjustment mechanism may comprise a link assembly coupling the deck to the middle hull, wherein the link assembly is configured to permit movement of the middle hull relative to the deck from a retracted position, where the middle hull is proximate to an underside of the deck, to an extended position, where the middle hull is moved further from the underside, an actuator provided to position the middle hull between the retracted position and the extended position, and a control means configured to activate the actuator to thereby cause extension or retraction of the middle hull. In another embodiment, the middle hull is shorter than the port side hull and the starboard side hull. In another further embodiment, the control mean is a switch configured to activate the actuator and thereby extend or retract the middle hull. In another further embodiment, the hull adjustment mechanism further comprises a bubble level or visual level indicator providing visual readings indicative of the attitude. In another further embodiment, the leveling control system further comprises a level sensor providing readings indicative of the an attitude of the deck, wherein the control mean is a controller configured to receive the readings from level sensor and communicate control signals to the actuator to extend and retract the middle hull based on the readings to position the deck into a desired attitude. In another further embodiment, the link assembly includes a scissor linkage assembly coupling a bow end of the middle hull to the deck and a stern end of the middle hull is rotatably connected to the deck such that the middle hull may pivot about an axis upon actuation of the actuator.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

FIGS. 7A-7C illustrate an alternate linkage assembly and example operation thereof utilizable with the boat of FIG. 1.

FIGS. 8A-8C illustrate example operation of a segmented linkage assembly utilizable with the boat of FIG. 1.

FIGS. 9A-9C illustrate an alternate example operation of a segmented linkage assembly utilizable with the boat of FIG. 1.

FIGS. 10A-10E illustrate yet another alternate example operation of a segmented linkage assembly utilizable with the boat of FIG. 1

DETAILED DESCRIPTION

The present disclosure is related to pontoon and multi-hull watercraft and, more particularly, to systems for adjusting position of a pontoon or hull within the water relative to a deck or floor of the watercraft.

Figure 1:
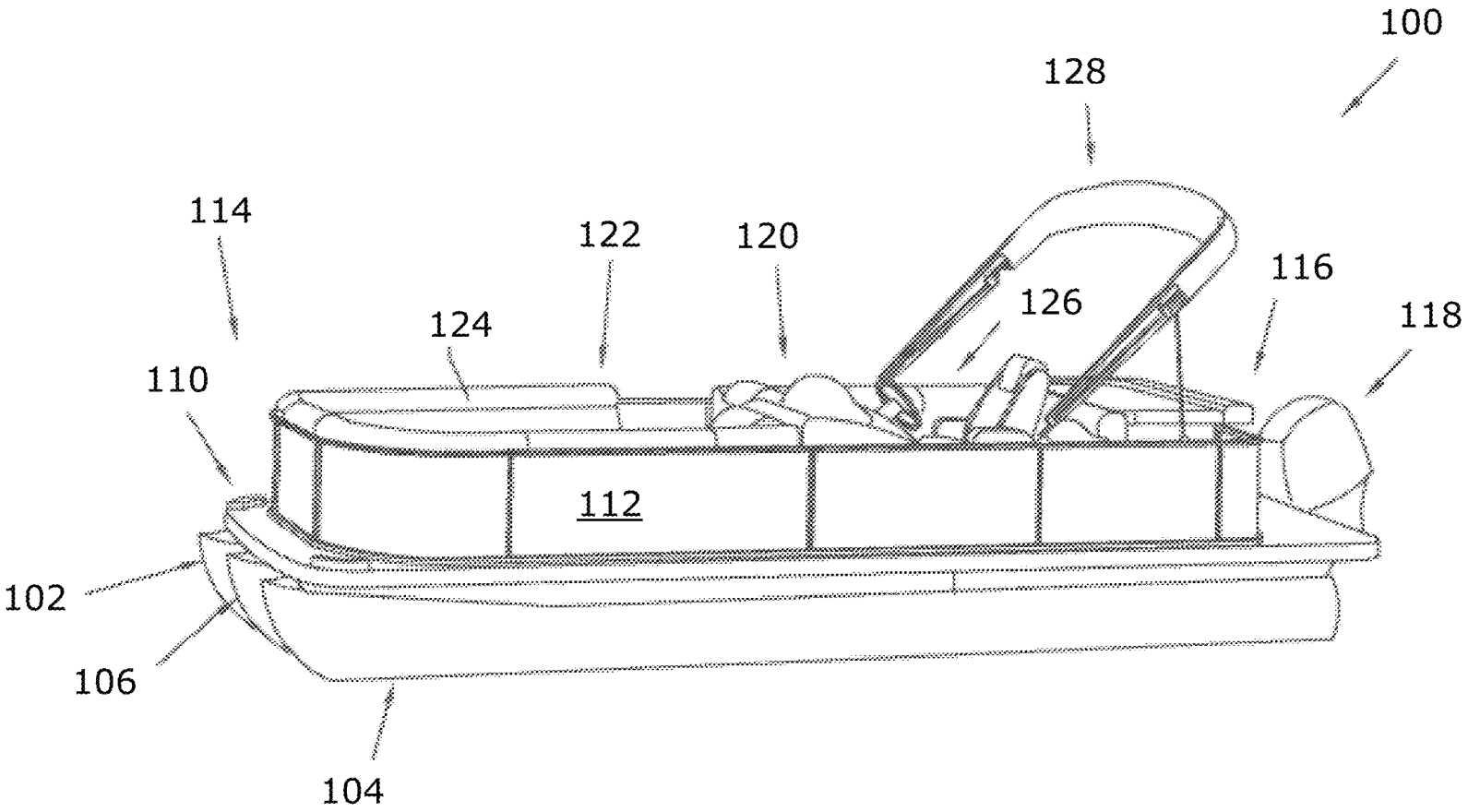
FIG. 1 is a perspective view of a pontoon boat that may incorporate the principles of the present disclosure.

FIG. 1 is a perspective view of an example pontoon boat 100 that may incorporate the principles of the present disclosure. The depicted pontoon boat 100 is just one example pontoon boat that can suitably incorporate the principles of the present disclosure. Indeed, many alternative designs and configurations of the pontoon boat 100 may be employed, without departing from the scope of this disclosure. For example, while the illustrated pontoon boat 100 incorporates a triple pontoon/hull design (i.e., a triton), aspects of the present disclosure may instead be incorporated on a pontoon boat having a double pontoon/hull design or a watercraft having more than three (3) pontoons. Moreover, aspects of the present disclosure may be incorporated on various other multi-hull watercraft, including but not limited to catamarans or trimarans, etc.

As illustrated, the pontoon boat 100 comprises a plurality of pontoons, including an outer pair of pontoons 102, 104 and a middle pontoon 106. The pontoons 102, 104, 106 are longitudinally extending buoyant members or cylinders upon which pontoon boat 100 floats and rides in a body of water (not depicted). The pontoon boat 100 also includes a deck 100 above (on top of) the pontoons 102, 104, 106. Here, the deck 110 extends in a generally horizontal plane and an upper or top surface thereof defines a floor of the pontoon boat 100. The deck 110 is mounted on and supported by the plurality of pontoons 102, 104, 106. The pontoon boat 100 also includes a railing 112 extending around deck 110. In the exemplary embodiment shown, the railing 112 encircles an inner portion of deck 110 and extends from a front or bow end 114 of deck 110 to a rear or stern end 116 of the deck 110. In some embodiments, the railing 112 may be spaced rearward of the front end 114 of the deck 110 to provide a forward deck portion without a railing. In some embodiments, the railing 112 may be spaced forward of the rear end 116 of the deck 110 to provide a rearward deck portion without a railing. In the illustrated example, the pontoons 102, 104, 106 are all of equal length. However, in some examples one or more of the pontoons 102, 104, 106 are of different size than the others, for example, the middle pontoon 106 is a "half pontoon" meaning it is shorter than the starboard and port side pontoons 102,104.

The pontoon boat 100 also includes a power source, engine, or motor 118. In the illustrated example, the motor 118 is an outboard engine, operably coupled at the rear end 116 of the deck 110. However, in other examples, the motor 118 may be mounted to the middle pontoon 106. Also, in other embodiments, power source 28 may comprise an inboard/outboard drive or a multi-engine configuration.

Seating areas may be provided on the deck 110 of the boat, such as a rearward seating area 120 and/or a forward seating area 122. The forward seating area 122 includes a plurality of seats 124 for passengers of the pontoon boat 100. Similarly, the rearward seating area 120 may include a plurality of seats in which occupants may be seated while riding on the pontoon boat 100. The rearward seating area 120 also includes an operator area 126 having at least one actuatable operator input for operating the engine 118 and the pontoon boat 100. The pontoon boat 100 also includes a collapsible canopy 128 pivotally coupled to the railing 112. The canopy 128 is pivotable between a stored configuration (shown in FIG. 1) and a deployed configuration in which the canopy 128 covers at least a portion of the rearward seating area 120 and/or the forward seating area 122. In some embodiments, the canopy 128 may comprise an upper frame fixedly coupled to the railing 112. In other embodiments, the canopy 128 may comprise a hard-shell cover or superstructure for the deck 110.

As described herein, the boat 100 may include a control system for adjusting the position of one or more of the pontoons 102,104,106 relative to the deck 110. Also as described herein, the boat 100 may include a control system for adjusting the position of motor 118 relative to the deck 110. For example, FIG. 1 illustrates the pontoons 102,104, 104 in a default position relative to the deck 110 where the pontoons 102,104,106 are retracted towards the deck 110, and the control system may be utilized to extend one or more of the pontoons 102,104,106 (individually or in groups of two or more together) further away from the deck 110.

When the boat 100 of FIG. 1 is floating in a body of water (not illustrated), with the pontoons 102,104,106 fully retracted, the deck 110 will be oriented at a default distance above the surface of the body of water. The motor 118 is mounted on the deck 110 here, and a propeller (not illustrated) of that motor 118 is sufficiently positioned in the water to apply sufficient propulsion to drive the boat 100 when the deck 110 is resting at the default distance above the surface of the water. However, when a load is applied on the top surface of the deck 110, for example, by passengers and coolers, etc., the boat 100 may displace more water such that the deck 110 rests closer to the surface of the water than is the case when no load is on the boat 100 such that the deck 110 rests at the default distance above the water. Moreover, when the load applied on the deck 110 is not uniformly applied to the deck 110, the boat 110 may not sit level within water. For example, if all of the load (e.g., passengers) is positioned proximate to the starboard side of the deck boat 100, that side of the boat 100 may displace more water and sit further down in the water such that the deck 110 at the starboard edge of the boat 100 is closer to the surface of the water than the port side of the deck 110 (and closer than the default distance); and in this example, the control system may be utilized to extend the starboard side pontoon 102 further into the water to enhance buoyancy (create additional buoyant force) on the starboard side of the boat 100 to raise the starboard side of the deck 110 and thereby level the deck 110. Also, where the boat 100 in FIG. 1 is sitting in the water with the deck 110 being generally level at the default distance above the water surface, all of the pontoons 102, 104,106 may be extended to uniformly enhance buoyancy on the entirety for the deck 110 thereby raising the height at which the deck 110 sits above water (i.e., lifting the deck 110 above the water surface to a distance greater than the default distance); and this feature may be beneficial, for example, when the boat 110 is pulling up to a pier or dock that is higher than the deck 110 surface such that deck 110 is raised up out of the water to a height that is closer to that of the pier or dock such that passengers need not encounter danger when disembarking the boat 100.

The pontoons 102,104,106 are movably attached or coupled to the deck 110. In the illustrated examples, the pontoons 102,104,106 are movably attached or coupled to the deck 110 via linkage assemblies (obscured from view in FIG. 1). Any one or more of the pontoons 102,104,106 may be movably attached or coupled to the deck 110. Thus, in some examples, just the middle pontoon 104 is movably attached or coupled to the deck 110; whereas, in other examples, just the outer pontoons 102,106 are movably attached or coupled to the deck 110; and whereas, in other examples, all of the pontoons 102,104,106 are movably attached or coupled to the deck 110. Thus, it should be appreciated that the following description of the linkage assemblies is applicable for movably coupling any one or more of the pontoons 102,104,106 to the deck 110.

Figure 2:
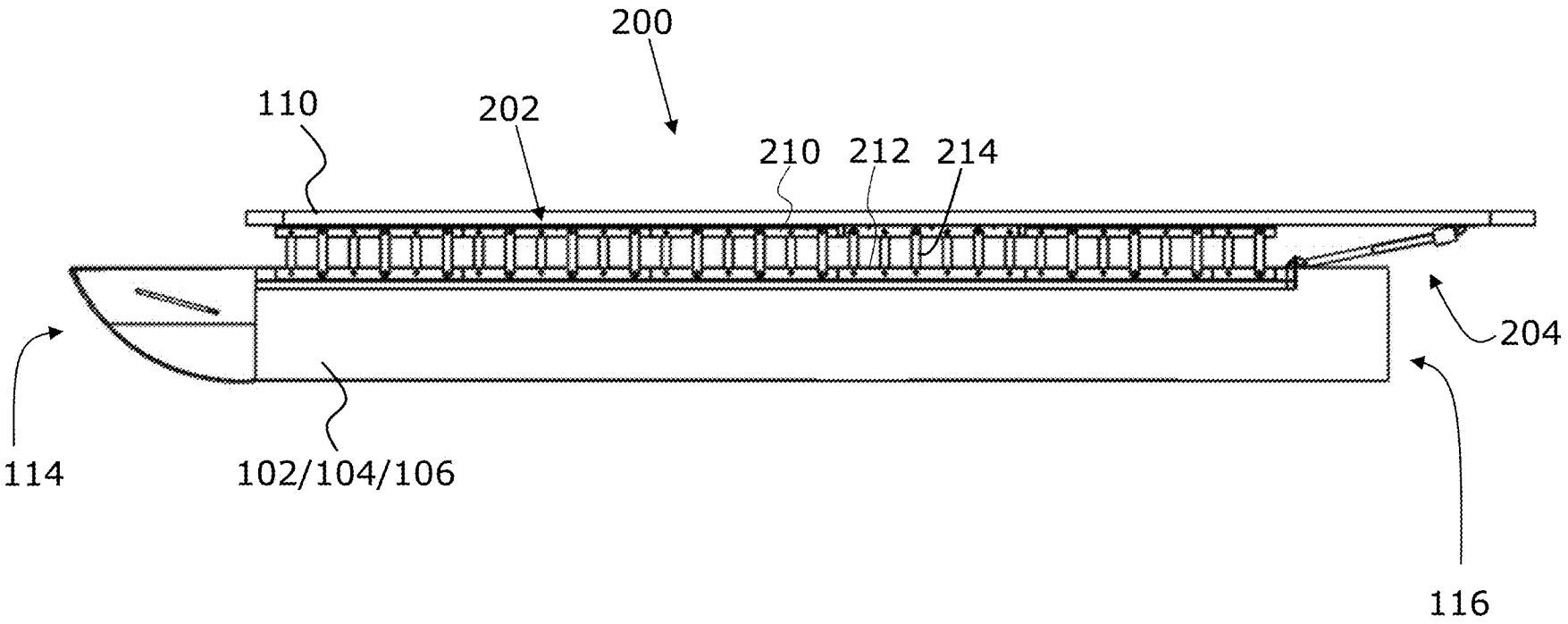
FIG. 2 is a side view of a pontoon positioning assembly/mechanism utilizable to extend or retract a pontoon of the pontoon boat or otherwise adjust position of the pontoon within the water.

FIG. 2 illustrates an exemplary pontoon actuation mechanism 200 utilizable with the pontoon boat 100 of FIG. 1, according to one or more embodiments of the present disclosure. In the illustrated example, the pontoon actuation mechanism 200 comprises a linkage assembly 202 and an actuator 204. The linkage assembly 202 movably attaches or couples one of the pontoons 102,104,106 to the deck 110 of the boat 100, and the actuator 204 is operable to cause actuation of (or driving) the linkage assembly 202 to move (extend or retract) the respective pontoon 102,104,106 associated with such actuation mechanism 200. It will be appreciated that while FIG. 2 illustrates a single pontoon, the actuation mechanism 200 could be provided on any one or more of the pontoons 102,104,106 and, in some examples, each of pontoons 102,104,106 is movable (extendable and retractable) as described herein. Also, the illustrated linkage assemblies 202 are just one type of linkage assembly, and other types of linkage assemblies may be utilized without departing from the present disclosure, such as a scissor linkage assembly which would permit vertical translation/movement of the pontoons.

In the illustrated example, the link assembly 202 includes an upper frame 210, a lower frame 212, and a plurality of links 214 extending between and rotatably interconnecting the upper and lower frames 210, 212. Here, the upper and lower frames 210, 212 extend substantially the entire length of the pontoon 102,104,106, between the front and rear ends 114,116, such that an individual one of the illustrated link assemblies 202 may be utilized to couple the pontoon 102,104,106 to the deck 110; however, as described below, the pontoon 102,104,106 may be coupled to the deck 110 via a plurality of independent link assemblies.

Each of the links 216 includes an upper end that is rotatably connected to the upper frame 210 (e.g., at an upper pin or rivet), such that the link 214 may rotate relative to the upper frame 210 (e.g., about the upper pin or rivet), and each of the links 216 includes a lower end that is rotatably connected to the lower frame 212 (e.g., at a lower pin or rivet), such that the link 214 may rotate relative to the lower frame 212 (e.g., about the lower pin or rivet).

The pontoon positioning assembly/mechanism 200 is utilizable to move the pontoon 102,104,106, for example, between a fully extended position illustrated in FIG. 2, and a fully retracted position. By coupling any one or more of the pontoons 102,104,106 to the deck 110 via the linkage assembly 200, the pontoon 102,104,106 may move (e.g., swing or pivot, translate, or rotate) relative to the deck 110 of the boat 100. When moved into the fully extended position, the pontoon 102,104,106 may be oriented lower/deeper into the water than it would normally be oriented, to thereby enhance or increase buoyant force and thereby exert increase the upward force buoyant force on the deck 110 of the boat 100.

An actuator 204 is utilized to articulate the linkage assembly 202 and thereby move (or pivot, translate, or rotate) the pontoon 102,104,106 between the fully retracted position and the fully extended position (FIG. 2) and to various positions there-between. An example of the actuator 204 is further illustrated in FIGS. 3A and 3B. In the illustrated example, the actuator 204 comprises an actuation portion 302 (e.g., a linear actuator, pneumatic cylinder, hydraulic cylinder, etc.) and a drive rod 304 configured to extend from and retract within actuation portion 302 of the actuator 204. The drive rod 304 may be rotatably attached to a rear wall/member 306 of the lower frame 212. Similarly, the actuation portion 302 may be rotatably to an underneath surface of the deck 110. It should be appreciated that, while the actuator 204 is illustrated and described as being a linear actuator or pneumatic cylinder, various other types of actuators or devices may be utilized for swinging/moving the pontoon 102,104,106 as described herein. In addition, it should be appreciated that, while the deck 100 illustrated herein is depicted as a simple planar surface member, the deck may comprise an assembly of materials/members. Thus, in some example, the deck 110 may be a deck assembly comprising top layer of decking material defining the top surface of the boat 100, one or more supportive cross members on an underside of the decking material. In these examples, the actuator(s) 204 may be connected to either the decking material's underside or to one or more of the supportive cross members. Also, in these embodiments, one or more plates may be attached on the supportive cross members and thereby span between one or more supportive cross members to define a mounting surface, and the actuator(s) 204 may be attached on such mounting surface defined by the plates.

Figures 3A, 3B:
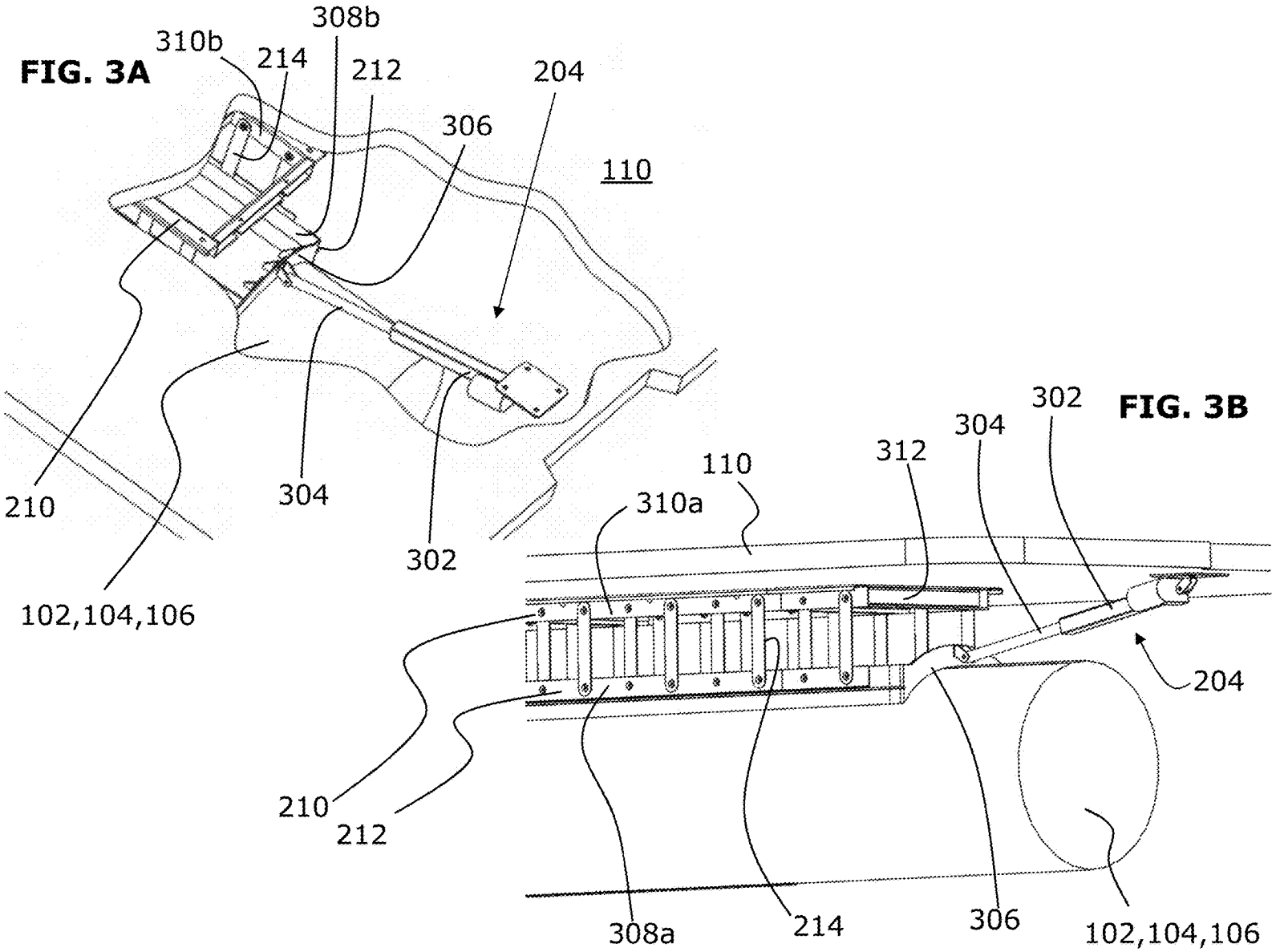
FIGS. 3A-3B are detailed view of the pontoon positioning assembly/mechanism of FIG. 2.

FIGS. 3A and 3B also further illustrate the pontoon positioning assembly/mechanism 200. Here, the lower frame 212 generally comprises a rectangular sidewall permanently attached on a surface of the pontoon 102,104,106, and such rectangular sidewall includes the a pair of longitudinally extending sidewalls 308*a*,308*b* (extending the length of the pontoon 102,104,106), and a rear wall 306 and a front wall (not illustrated) that extend between the sidewalls are contoured with a radius matching that of the pontoon 102,104,106, such that the lower frame 212 conforms to the surface of the pontoon 102,104,106 for secure attachment thereon. The upper frame 210 is a rectangular sidewall structure permanently attached on a underside of the deck 110, and such rectangular sidewall includes the a pair of longitudinally extending sidewalls 310*a*,310*b* (extending the length of the pontoon 102,104,106), and a rear wall 312 and a front wall (not illustrated) that extend between the sidewalls are contoured with a radius matching that of the pontoon 102,104,106. The links 214 are rotatably attached to the lower sidewalls 308*a*,308*b* and the upper sidewalls 310*a*,310*b*, with a first set of the links 308 interconnecting and rotatably coupling the sidewalls 308*a*,310*a* and a second set of the links 308 interconnecting and rotatably coupling the opposite sidewalls 308*b*,310*b*. Also, in some examples and as illustrated in FIG. 3B, as to each set of the links 308, some of the links 308 are attached on an outer face of the sidewalls and some are attached on the inner face of the sidewalls so that they don't interfere/contact each other when articulated into a fully retracted position. For example, regarding the first set of the links 308 interconnecting and rotatably coupling the sidewalls 308*a*, 310*a*, a first link 308 may be connected on an outer face of the sidewalls 308*a*,310*a*, and then the next link 308 would be connected on an inner face of the sidewalls 308*a*,310*a*, and then the next link 308 would be connected on the outer face of the sidewalls 308*a*,310*a*, and then the next link 308 would be connected on the inner face of the sidewalls 308*a*,310*a*, etc.

Figure 4:
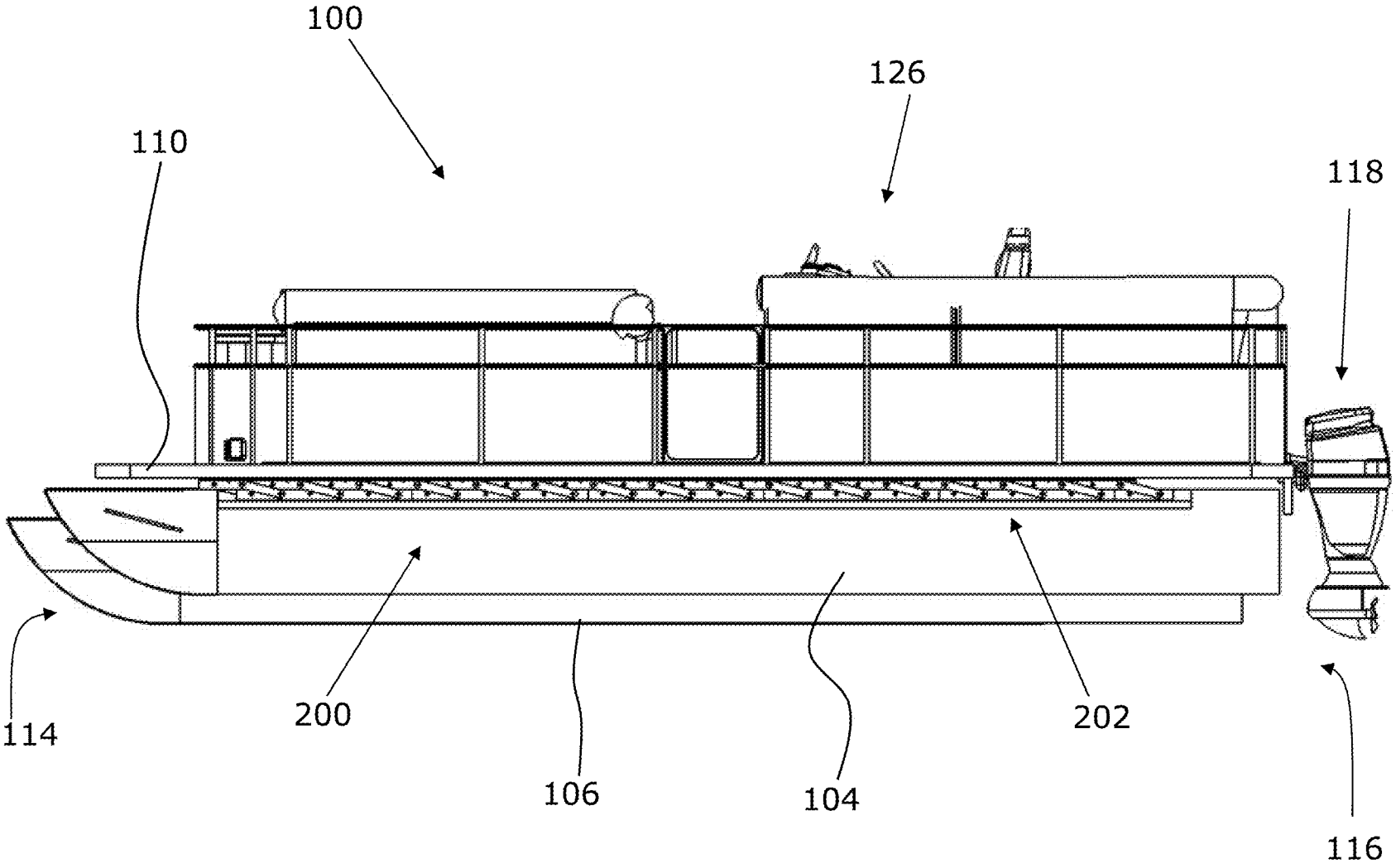
FIG. 4 is a side view of a pontoon boat incorporating the pontoon drive mechanism of FIG. 2 wherein the middle pontoon has been extended.

FIG. 4 is a side view of the pontoon boat 100 incorporating the pontoon actuation mechanism 200 of FIGS. 2, 3A and 3B, according to one or more embodiments of the present disclosure. In the illustrated example, pontoon actuation mechanisms 200 are provided on each of the pontoons 102,104,106, such that each of the pontoons 102,104,106 is movably connected to the deck 110 via one of the linkage assemblies 202. Here, the pontoon actuation mechanism 200 provided on the middle pontoon 106 has been activated to move or swing the middle pontoon 106 into an (at least partially) extended position. Also in this example, the pontoon actuation mechanism 200 provided on the port side pontoon 104 is un-activated such that the port side pontoon 104 is in a fully retracted position where such pontoon 104 is pulled up proximate to the under-side of the deck 114; whereas, the starboard side pontoon 104 and the pontoon actuation mechanism 200 associated therewith are obscured from view. In this example, the operator of the boat 100 may utilize a control (e.g., in the operator area 126) to control position or orientation of any or all of the pontoons 102, 104,106 in the water. Here, for example, the operator utilized the control to actuate the pontoon actuation mechanism 200 associated with the middle pontoon 106 and thereby actuate the linkage assembly 202 via the actuator 204 and thereby swing the middle pontoon 106 downward and forward (relative to the other pontoons 104,102) towards the front end 114, as shown in FIG. 4. This feature may be useful for maintaining the deck 110 in a level state or orientation, or raising (or lowering) the level/height above water of the deck 110 to make it more accessible to a dock or other watercraft.

Figure 5A:
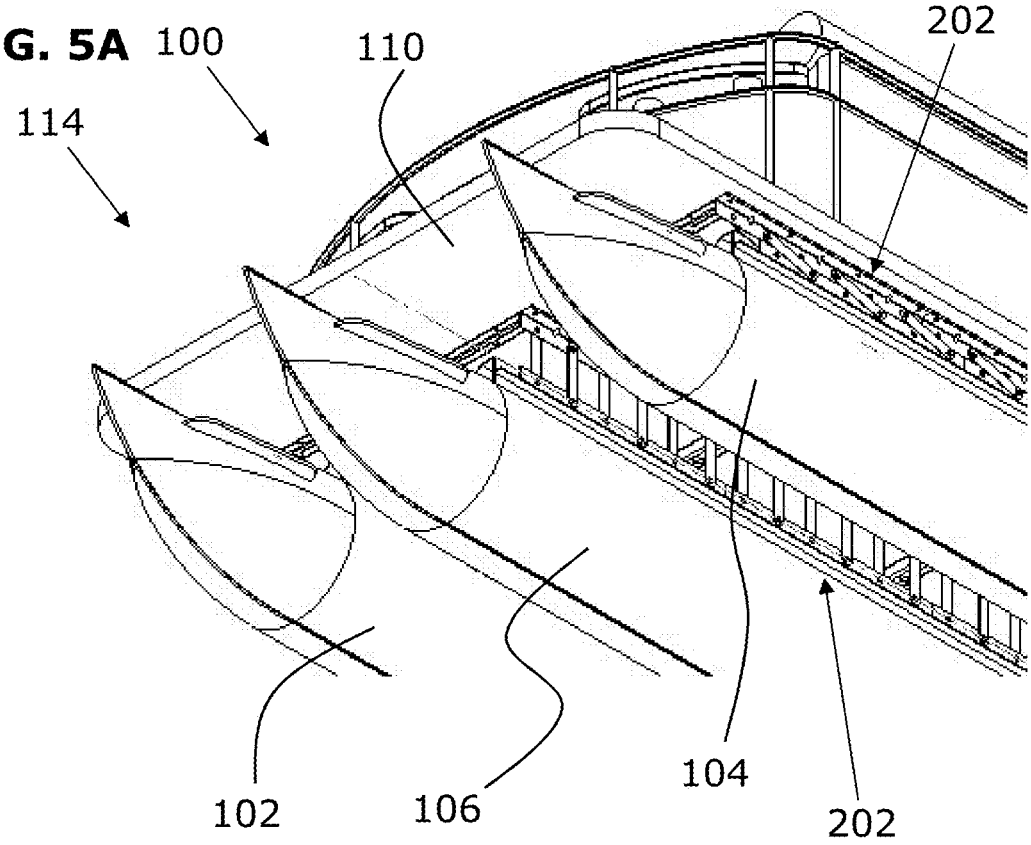
FIG. 5A is a partial bottom perspective view of the front end of the pontoon boat of FIG. 4.
Figure 5B:
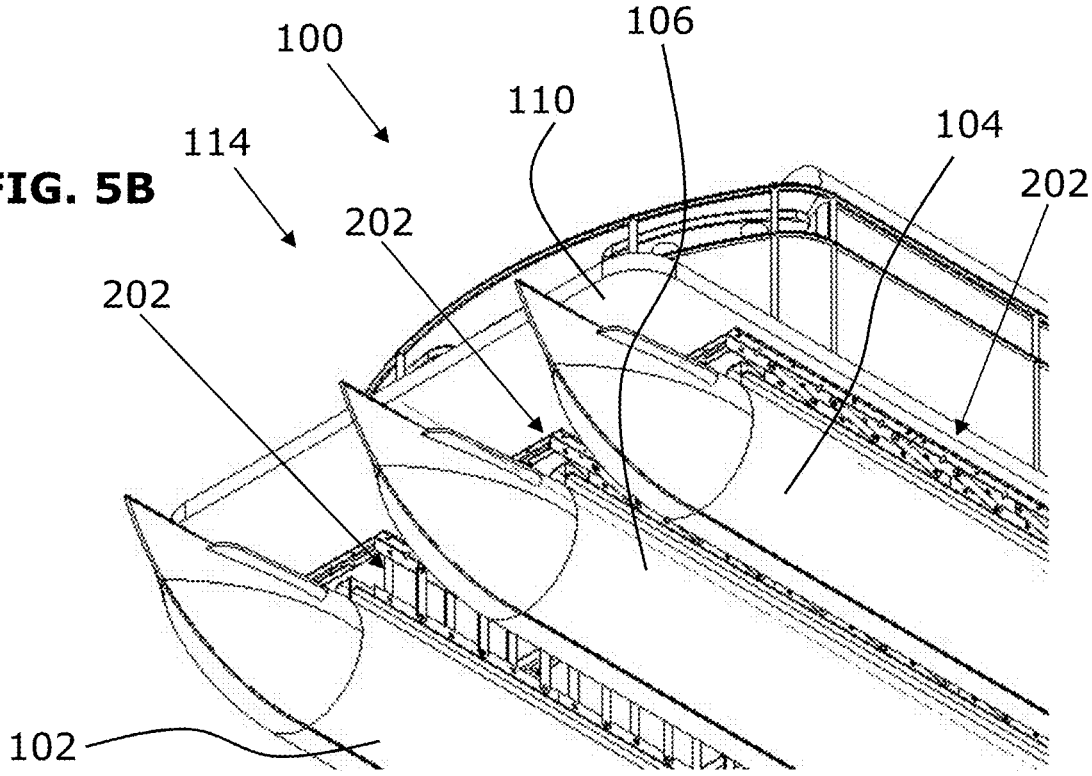
FIG. 5B is a partial bottom perspective view of the front end of the pontoon boat where the starboard side pontoon has been extended.

FIG. 5A illustrates a bottom perspective view of the front end 114 of the pontoon boat 100 of FIG. 4. Here, the middle pontoon 106 is shown in an extended position relative to the deck 110, whereas the side pontoons 102,104 are shown in retracted positions where they are pulled up proximate to the under-side of the deck 110. FIG. 5B illustrates an example where both the port side tune 104 and the middle pontoon 106 are in retracted positions relative to the deck 110, whereas the starboard side tune 102 has been swung into the extended position.

Figures 6A, 6B:
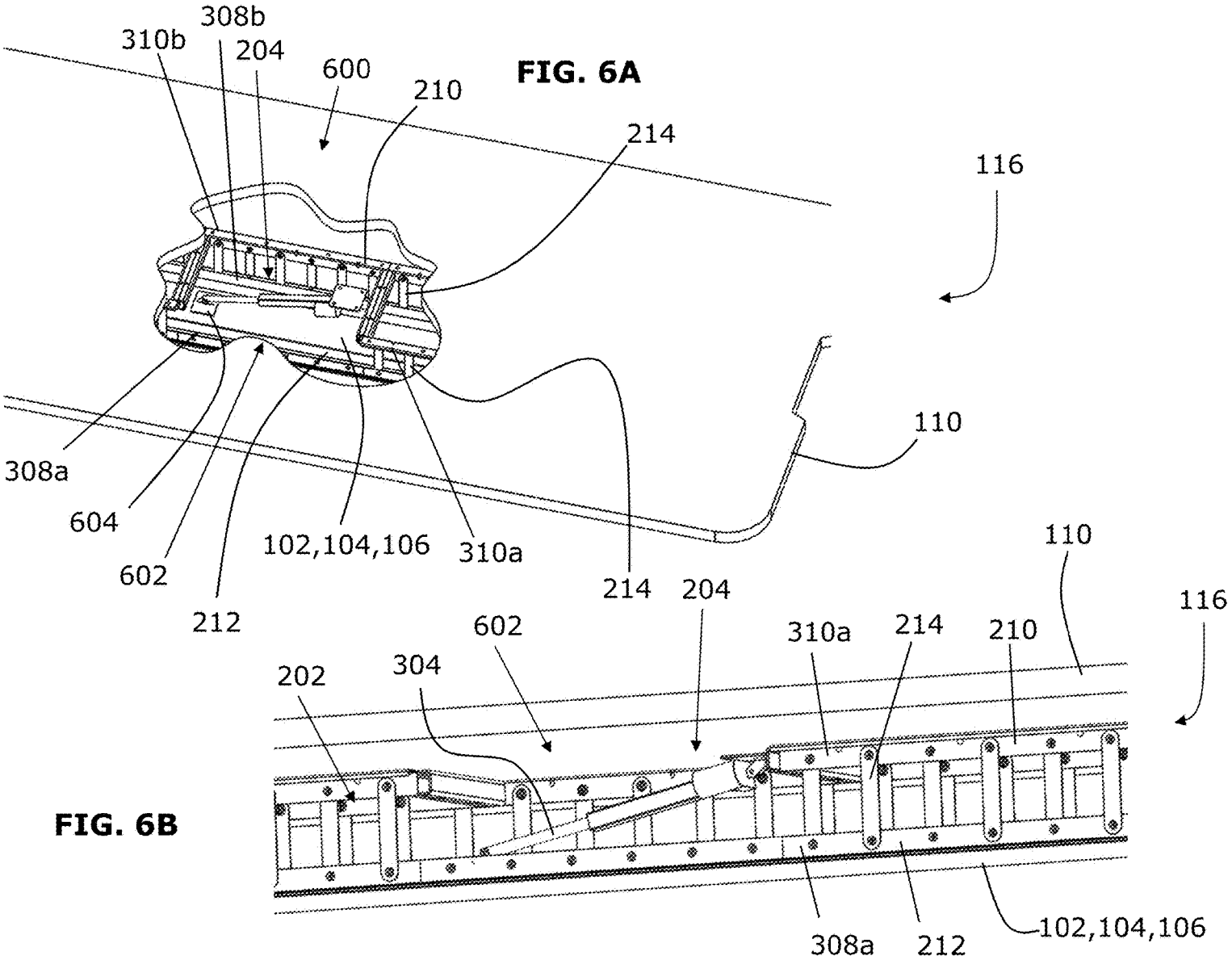
FIGS. 6A-6B illustrate an alternate pontoon positioning assembly/mechanism utilizable with the boat of FIG. 1.

FIGS. 6A-6B illustrate an alternate pontoon actuation mechanism 600 utilizable with the pontoon boat 100 of FIG. 1, according to one or more embodiments of the present disclosure. The pontoon actuation mechanism 600 is similar to the pontoon actuation mechanism 200 described above, except that the pontoon actuation mechanism 600 is provided at a middle (or interior) position relative to the pontoon 102,104,106 so as to drive such pontoon from such middle (or interior) position, as opposed to the above described pontoon actuation mechanism 200 which drives the pontoon 102,104,106 proximate the rear end 116. Thus, as illustrated, the pontoon actuation mechanism 600 includes the linkage assembly 202 and the actuator 204, which may be similar to that described above except configured to utilization at a midpoint or interior location along the pontoon 102,14,106. As illustrated, a gap 602 is defined within the linkage assembly 202, and the gap 602 is designed to fit the actuator 204 and permit the extension and retraction of the drive rod 304 of the actuator 204 as described above to move (or swing or drive) the pontoon 102,104,106 as described herein. In the illustrated example, the drive rod 304 is rotatably coupled to a bracket 604 that is mounted on the pontoon 102,104,106, rather than on a rear wall of the lower frame 212 as described above. In the illustrated example, the sidewalls 310*a*,310*b* of the upper frame 210 and the sidewalls 308*a*,308*b* of the lower frame 212 extend along the lateral sides of the gap 602, such that the gap 602 is defined within the linkage assembly 202. Also, while a portion of the upper sidewalls 310*a* has been removed from the illustrations in FIGS. 6A-6B for ease of illustration, in some examples, segments of the sidewalls 308*a*,308*b* and/or the sidewalls 310*a*,310*b* may be removed such that linkage assembly 202 is discontinuous or segmented. Also in the illustrated example, the actuator 204 is rotatably attached to the deck 110, but may instead be attached to a portion of the upper frame 210 (or lower frame 212) and similarly, the distal end of the drive rod 304 may be rotatably attached to a portion of the lower frame 212 (or upper frame 210).

Figure 7A:
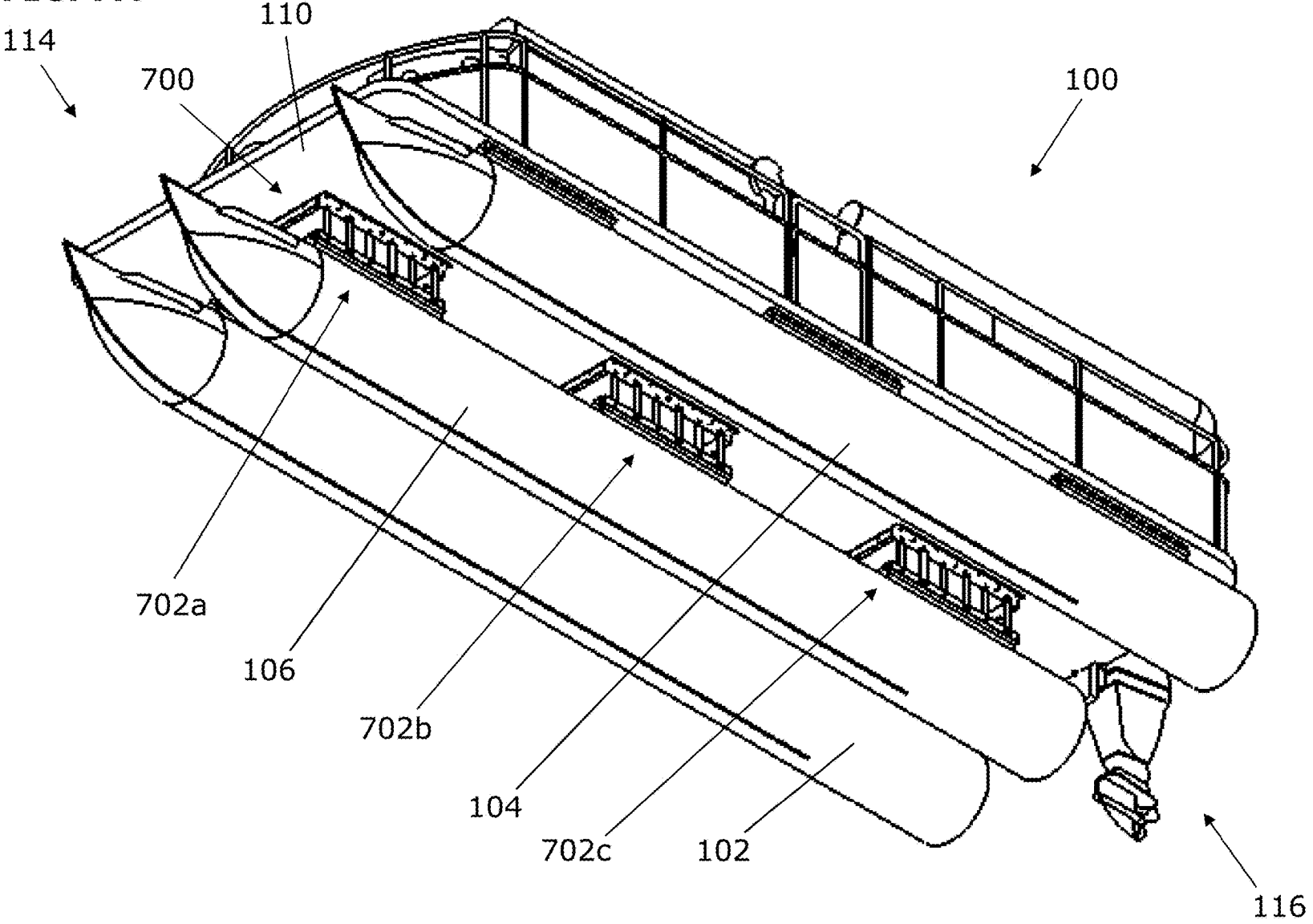

FIGS. 7A-7C illustrate an alternate linkage assembly 700 for movably attaching the pontoons 102,104,106 to the deck 110 of the boat 100, according to one or more alternate embodiments. In the illustrated example, the the middle pontoon 106 is movably attached to the deck 110 of the boat via the linkage assembly 700. In other embodiments, either or both of the side pontoons 102,104 are also (or instead) movably attached to the deck 110 of the boat via the linkage assembly 700 (or via the linkage assembly 202 described above). In the illustrated example, the linkage assembly 700 includes a plurality of linkage assembly segments 702*a*, 702*b*,702*c*. While the illustrated example illustrates the linkage assembly 700 as comprising three (3) such linkage assembly segments, it may include more or less than three (3) such linkage assembly segments. In particular, FIG. 7B illustrates the linkage segments 702*a*,702*b* (the linkage segment 702*c* is obscured from view) of linkage assembly 700 when articulated out (uncollapsed) so as to position the middle pontoon 106 in the extended position, whereas FIG. 7C illustrates the linkage segment 702*a* (the linkage segments 702*b*,702*c* are obscured from view) of linkage assembly 700 when articulated in (collapsed) so as to position the middle pontoon 106 in the retracted position.

One or more of the linkage segments 702*a*,702*b*,702*c* may be powered or actuated. For example, an actuator may be provided to drive one or more of the linkage segments 702*a*,702*b*,702*c*. FIGS. 8A-8C illustrate an example where the rear most linkage segment 702*c* is independently powered via the actuator 204 but where the other two (2) linkage segments 702*a*,702*b* are unpowered (slave) linkages. In other examples, either of the other two (2) linkage segments 702*a*,702*b* may be the powered linkage, instead of the linkage segment 702*c*. FIGS. 9A-9C illustrate an example where a pair of the linkage segments are powered, according to one or more embodiments. Here, one of the actuators 204 is provided on the front linkage segment 702*a* and the rear linkage segment 702*c* (i.e., linage segments 702*a*,702*b* are powered) whereas the middle linkage segment 702*b* is unpowered (i.e., a slave linkage segment). In these embodiments, the front actuator 204*a* and the rear actuator 204*c* may be timed such that they operate in unison to evenly extend or retract the pontoon 102,104,106. In even other examples, the middle linkage segment 702*b* is provided with an actuator (i.e., a middle actuator 204*b*) such that the middle linkage segment 702*b* is powered, and, in these examples, the actuators 204*a*,204*b*,204*c* may be timed such that they operate in unison. In even other examples, instead of the front and rear linkage segments 702*a*,702*c* being powered, the middle linkage segment 702*b* and either the front linkage segment 702*a* or the rear linkage segment 702*c* are powered. The front and rear actuators 204*a*,204*c* may be synchronized with a motor control, e.g., via a hall effect sensor, or the pair of actuators may be physically wired together, or communicate wirelessly with each other. However, the fore and aft actuators need not be timed, such that they can operate independently such that a fore/aft portion of the pontoon is extended more or less than the aft/fore portion of the pontoon (i.e., to vary the rake of the pontoon).

Figure 10D:
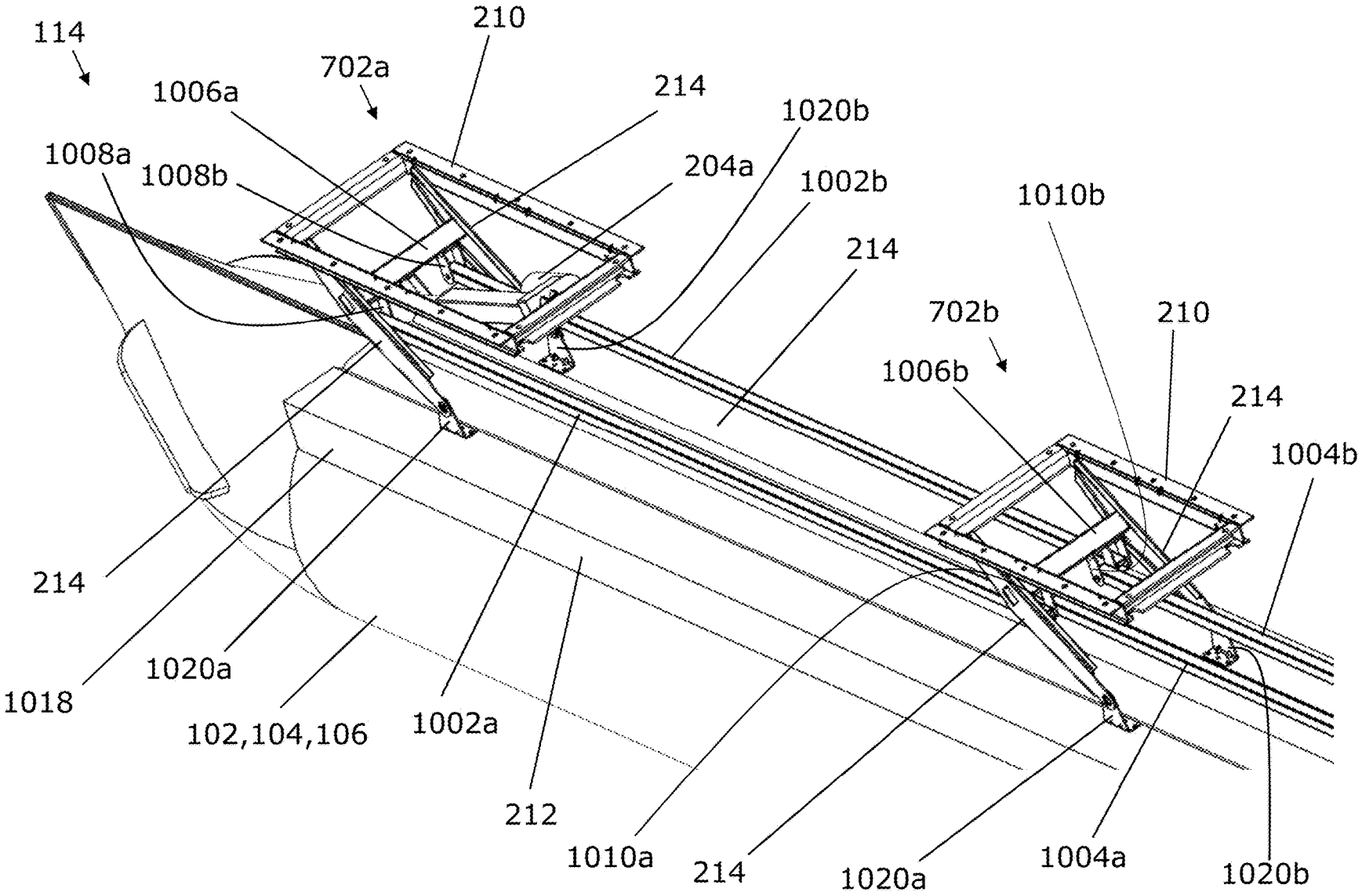
Figure 10E:
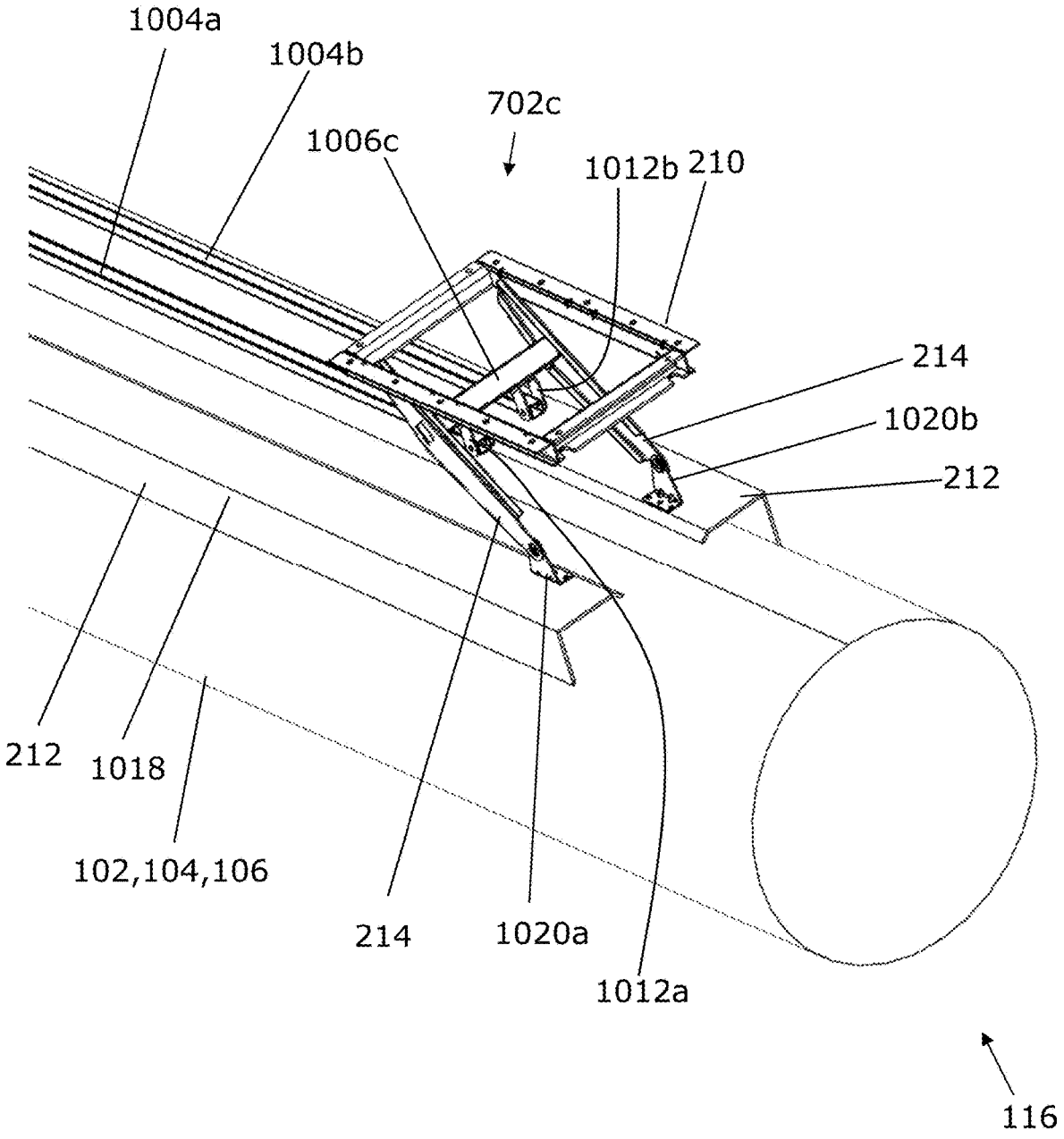

In some examples, the linkage segments 702*a*,702*b*,702*c* may be coupled together (timed) such that the power applied by the actuator 204 to one of the linkage segments 702*a*, 702*b*,702*c* is transmitted to the other non-powered linkage segments 702*a*,702*b*,702*c*. For example, FIGS. 10A-10E illustrate an example where a mechanical coupling is utilized to transmit power from a single actuator 204 to all of the linkage segments 702*a*,702*b*,702*c*, according to one or more embodiments. In the illustrated example, the actuator 204 is provided on the front linkage segment 702*a*, to thereby power the front linkage segment 702*a*, and the mechanical coupling mechanically transmits power of the actuator 204 from the front linkage segment 702*a* to the middle and rearward linkage segments 702*b*,702*c*. As shown in FIG. 10D, the mechanical coupling includes a first pair of coupling members 1002*a*,1002*b* coupling the links 214 of the front linkage segment 702*a* to the links 214 of the middle linkage segment 702*b* and, as shown in FIGS. 10D-10E, the mechanical coupling also includes a second pair of coupling members 1004*a*,1004*b* coupling the links 214 of the middle linkage segment 702*b* to the links 214 of the rear linkage segment 702*c*. In particular, the first coupling member 1002*a* couples the port side link 214 of the front linkage segment 702*a* to the port side link 214 of the middle linkage segment 702*b*, the first coupling member 1002*b* couples the starboard side link 214 of the front linkage segment 702*a* to the starboard side link 214 of the middle linkage segment 702*b*, the second coupling member 1004*a* couples the port side link 214 of the middle linkage segment 702*b* to the port side link 214 of the rear linkage segment 702*c*, and the second coupling member 1004*b* couples the starboard side link 214 of the middle linkage segment 702*b* to the starboard side link 214 of the rear linkage segment 702*c*.

Here, each of the linkage segments 702*a*,702*b*,702*c* includes a brace 1006*a*,1006*b*,1006*c* extending between the port and starboard links 214 of the linkage segments 702*a*, 702*b*,702*c*. In particular, the first brace 1006*a* is provide between the links 214 of the front linkage segment 702*a*, the second brace 1006*b* is provide between the links 214 of the middle linkage segment 702*b*, and the third brace 1006*c* is provide between the links 214 of the rear linkage segment 702*c*. In the illustrated example, a pair of first coupling brackets 1008*a*,1008*b* are provided on the first brace 1006*a*, a pair of second coupling brackets 1010*a*,1010*b* are provided on the second brace 1006*b*, and a pair of third coupling brackets 1012*a*,1012*b* are provided on the third brace 1006*c*. A first end of the coupling member 1002*a* is rotationally attached (e.g., pinned) within the first coupling bracket 1008*a* and a second end of the coupling member 1002*a* is rotationally attached (e.g., pinned) within the second coupling bracket 1010*a*. Similarly, a first end of the coupling member 1002*b* is rotationally attached (e.g., pinned) within the first coupling bracket 1008*b* and a second end of the coupling member 1002*b* is rotationally attached (e.g., pinned) within the second coupling bracket 1010*b*. In the illustrated example, the second coupling brackets 1010*a*, 1010*b* are each double brackets meaning each of the coupling brackets 1010*a*,1010*b* may receive a pair of coupling members. Thus, as illustrated, a first end of the coupling member 1004*a* is rotationally attached (e.g., pinned) within the second coupling bracket 1010*a* and a second end of the coupling member 1004*a* is rotationally attached (e.g., pinned) within the third coupling bracket 1012*a*; and, similarly, a first end of the coupling member 1004*b* is rotationally attached (e.g., pinned) within the second coupling bracket 1010*b* and a second end of the coupling member 1004*b* is rotationally attached (e.g., pinned) within the third coupling bracket 1012*b*. In other examples, either or both end of any one or more of the mechanical coupling 1002*a*, 1002*b*,1004*a*,1004*b* shafts are rotatably mounted directly to the the links 214 (e.g., on an inner and/or outer face of the links 214).

In this example, the lower frame 212 is comprised of a pair of formed square corner segments 1018 that may be secured to the sides of the round pontoon 102,104,106 and thereby provide a flat surface onto which to mount the linkage assembly 700. In addition, the lower frame comprises a pair of right angle brackets 1010*a*,1010*b* on to which ends of the links may be rotatably attached (e.g., pinned). Here, the square corner segments extend substantially the length of the pontoon 102,104,106 such that two (2) lengths of such corner segment are provided on each of the pontoons 102,104,106. However, in other examples, the corner segments 1018 may be provided as a single component that are attached to each other at a top surface of the pontoon. Also, in some examples, the corner segments 1018 may be provided in shorter discrete lengths that are attached to the pontoons at locations thereon at which the linkage segments 702*a*,702*b*,702*c* are attached.

Figures 11A, 11B:
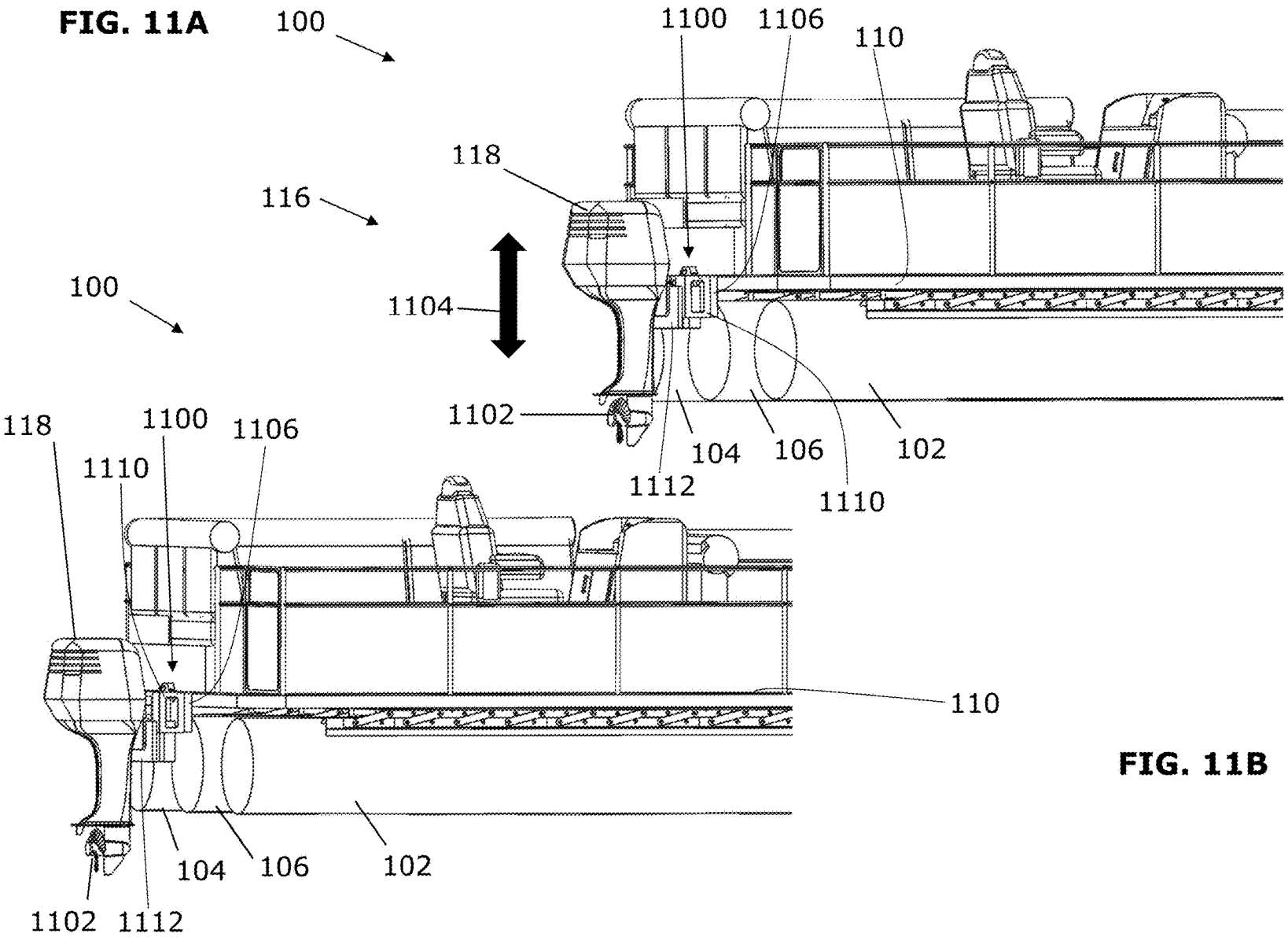
FIGS. 11A-11B illustrate an engine height adjustment mechanism utilizable with the boat of FIG. 1.
Figure 12A:
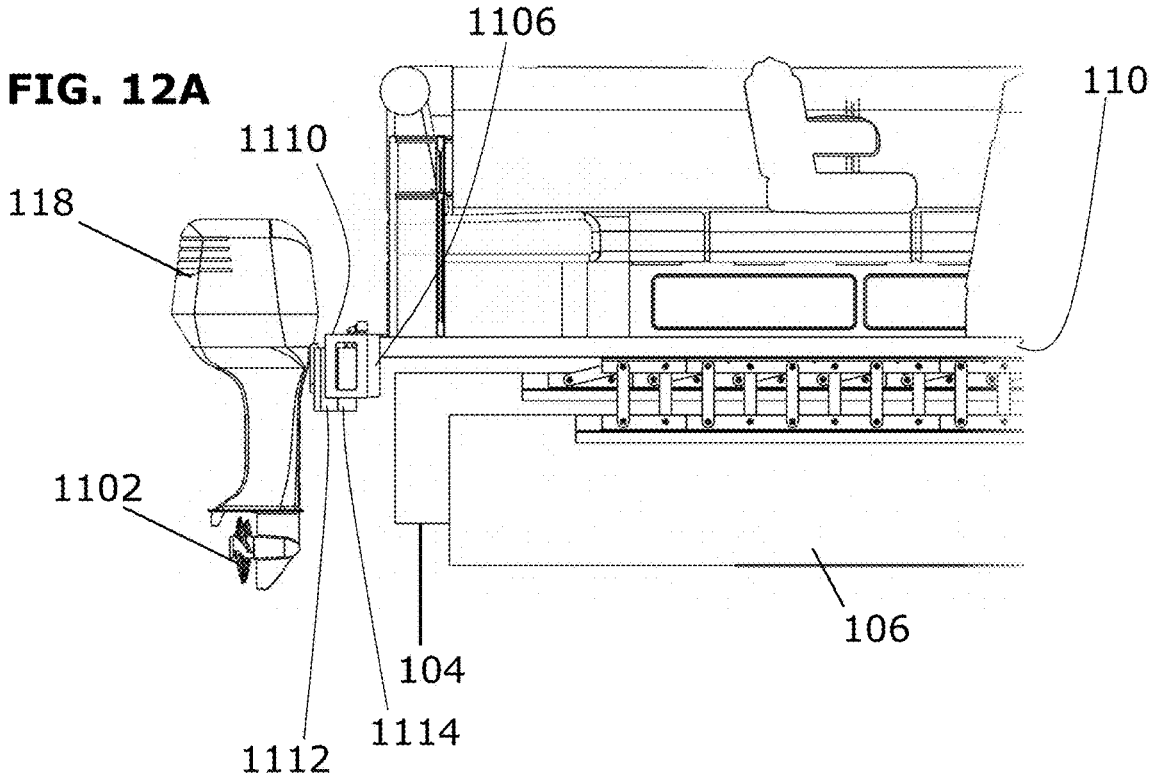
FIGS. 12A-12B illustrate alternate view of the engine height adjustment mechanism of FIGS. 11A-11B.
Figure 12B:
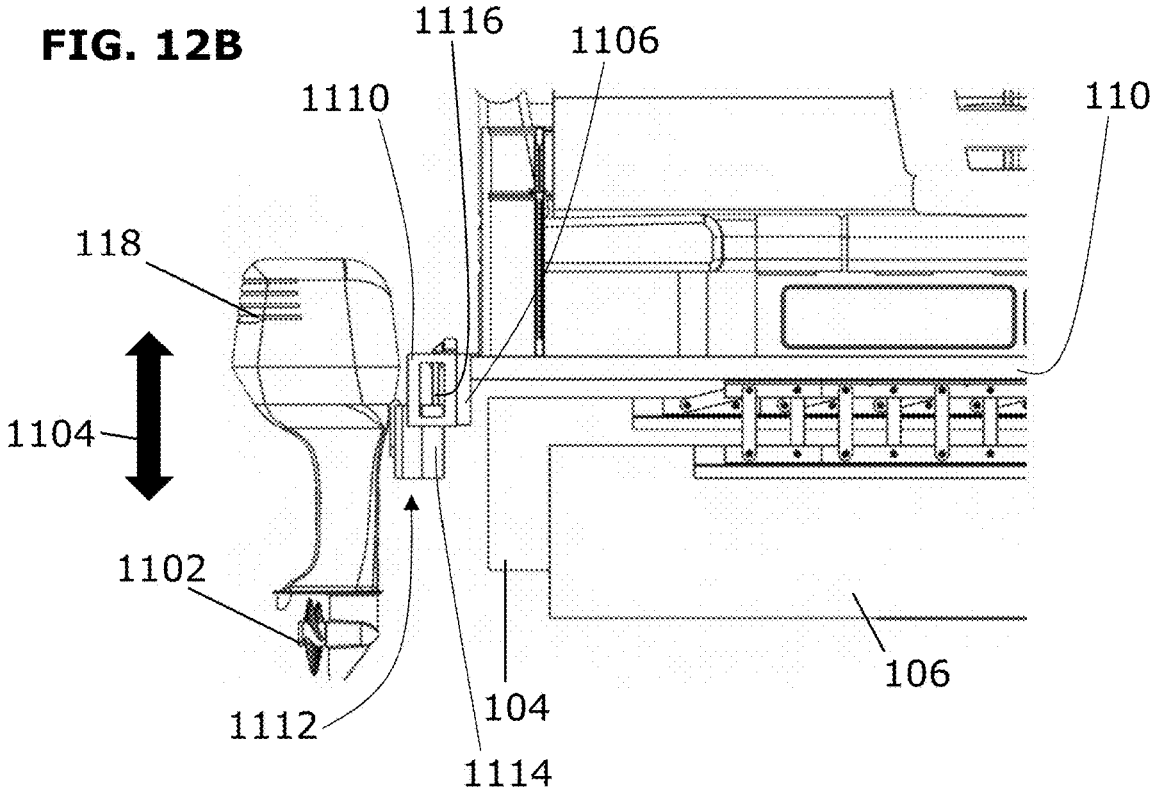

Also disclosed herein are systems and mechanisms for adjusting position of the motor 118 relative to the deck 110, and thereby control positon of the propeller within the water and thereby ensure that the propeller is sufficiently below water to provide propulsion. FIGS. 11A-11B and 12A-12B illustrate an exemplary motor position system 1100, according to one or more embodiments of the present disclosure. As illustrated, the motor position system 1100 is utilizable to raise or lower the motor 118 relative to the deck 110 of the boat 100 to thereby adjust position of a propeller 1102 of the motor 118 within the water. In the illustrated example, the motor position system 1100 is utilizable to vertically move the propeller 1102 in an upward or downward direction as indicated by arrow 1104. The motor position system 1100 may be controlled independently of the systems for controlling the above described pontoon actuation mechanisms, or such above described pontoon adjustment systems and the motor position system 1100 may be tied together such that the motor position system 1100 is automatically activated upon activation of the pontoon adjustment systems to raise or lower the motor 118 and thereby ensure the propeller 1102 is adequately/sufficiently positioned in the water for sufficient or ideal propulsion. FIGS. 11A and 12A illustrate the motor 118 and propeller 1102 in an upward most or retracted position, whereas FIGS. 11B and 12B illustrate the motor 118 and propeller 1102 in a downward most or extended position.

In the illustrated example, the motor position system 1100 is attached a transom 1106 of the boat 100. Here, the transom 1106 is the vertical member positioned at the stern of deck 110. In some examples, the transom 1106 may be raked at an angle, for example, at an angle extending rearward and downward from the deck 110.

The motor position system 1100 includes a base or bracket 1110 and a motor-side portion 1112 slidably coupled within the bracket 1110. As illustrated, the bracket 1110 is mounted on the transom 1106 of the boat 100, and the motor 118 is mounted on the motor-side portion 1112 of the motor position system 1100. Here, the motor-side portion 1112 includes an actuator 1114. The actuator 1114 has a drive rod 1116 extending therefrom and which may extend or retract upon activation of the actuator 1114. For example, when the actuator 1114 is activated to fully retract the drive rod 1116, the motor-side portion 1112 may be in a fully raised position within the bracket 1110 such that the motor 118 and propeller 1102 are at a fully retracted position relative to the deck 110. However, when the actuator 1114 is activated to fully extend the drive rod 1116, the motor-side portion 1112 may be in a fully lowered position within the bracket 1110 such that the motor 118 and propeller 1102 are at a fully extended position relative to the deck 110. The actuator 1114 may be various types of actuators, such as an electric actuator or a hydraulic actuator.

Figure 13:
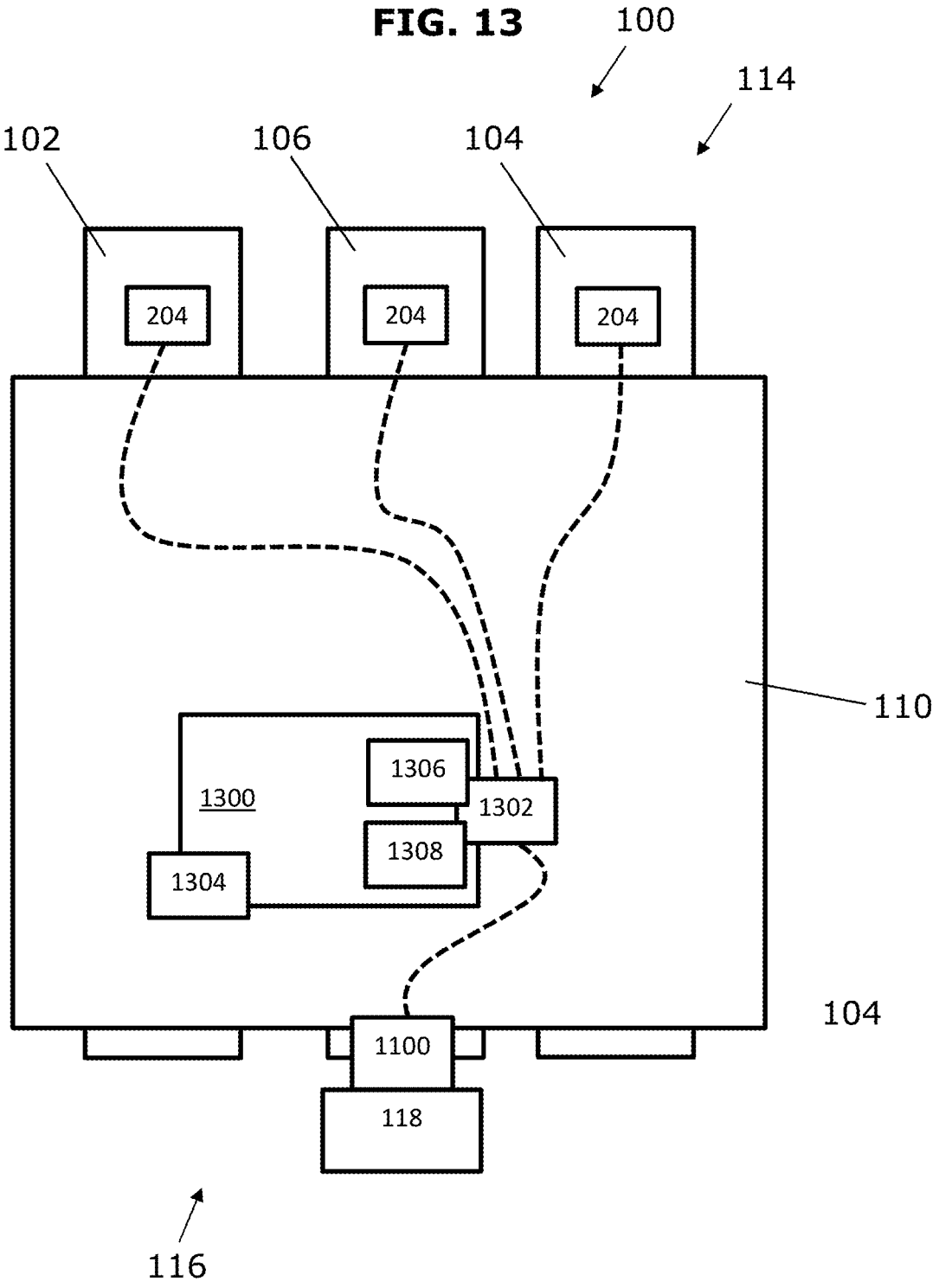
FIG. 13 is schematic of a level system utilizable with the boat of FIG. 1.

A leveling system and method for analyzing and correcting the attitude of the deck 110 of the boat is also disclosed herein. Thus, the above described pontoon adjustment assemblies described herein may be integrated within such a leveling system; and, in some embodiments, the motor position system 1100 may also be integrated within the leveling system. FIG. 13 is a schematic of an exemplary leveling control system 1300 according to one or more embodiments of the present disclosure. The leveling control system 1300 includes a controller 1302 and a level sensor 1304 that senses an attitude of the deck 110. The level sensor 1304 may comprise various types of sensors. The leveling control system 1300 may further include a processor 1306, a memory 1308, and a user interface. In some examples, the controller 1302 and the level sensor 1304 are integrated within a Microelectromechanical systems ("MEMS") chip, which senses temperature, altitude, speed, level state, gravity, etc.

The level sensor 1304 is connected to the controller 1302 and sends signals to the controller 1302 indicative of the attitude of the deck 110. The level sensor 1304 may communicate with the controller 1302 via a wire or wirelessly. In some examples, a visual level indicator is provided on the boat 100, e.g., in the operator area 126 or elsewhere on the deck 110, to provide a visual indication of an attitude of the deck (i.e., whether it is level). In some examples, the visual level indicator is a bubble level.

The controller 1302 actuates the actuators 204 connected to the pontoons 102,104,106 in response to data or signals received from the level sensor 1304. The controller 1302 may be configured to control any or all of the actuators 204 on the boat. For example, if the starboard side pontoon 102 has one or more actuators 204, the controller 1302 may be connected to those one or more actuators 204 of the starboard pontoon 102; if the port side pontoon 104 has one or more actuators 204, the controller 1302 may be connected to those one or more actuators 204 of the port side pontoon 104; and/or if the middle pontoon 106 has one or more actuators 204, the controller 1302 may be connected to those one or more actuators 204 of the middle pontoon 106. In the illustrated example, each of the pontoons 102,104,106 is powered by a single actuator 204 and the controller 1302 is configured to control activation of each of the three actuators 204. However, it should be appreciated that each pontoon 102,104,106 may be powered by two or more actuators (e.g., actuators 204*a* and 204*c* or 204*a*,204*b*,204*c*, etc.), as described above, and in such embodiments the each of the plurality of actuators of each pontoon may be connected to the controller 1302, and the controller 1302 may further be configured to time or synchronize operation of the actuators as to each pontoon. Thus, the controller 1302 may time or synchronize each actuator that powers the starboard side pontoon 102, the controller 1302 may time or synchronize each actuator that powers the port side pontoon 104, and the controller 1302 may time or synchronize each actuator that powers the middle pontoon 106.

In some examples, the user interface is integrated within existing control leveling control system 1300. The user interface 1310 may include a touch screen display and/or a plurality of toggle switches. In some examples, a toggle switch is operable to extend or retract each of the pontoons 102,104,106 such that the operator may activate the toggle switch corresponding with the pontoon that they would like to extend/retract. In some examples, the controller 1302 is programmed to monitor/sense amps drawn from the actuators to determine if the associated pontoon is fully extended or retracted. In some examples, the controller 1302 is programmed to constantly monitor attitude of the deck 110 and automatically extend or retract the appropriate pontoon to level the deck 110 as sensed by the sensor 1302; and in these embodiments, the controller 1302 may further control the speed at which the pontoons are extended or retracted to rapidly level the deck 110 and facilitate a smooth and constant level state of the deck 110 depending on the open water conditions with which the boat 100 is experiencing. In addition, where a MEMS chip is utilized, the controller 1302 may pull the various data sensed and captured by the MEMS ship to control leveling of the deck 110. In addition, the system controller 1302 may be configured to control the actuator 1114 which adjusts the height of the boat motor 118 such that the system 1300 may be programmed to maintain the propeller 1102 sufficiently within the water as the deck 110 height is adjusted. For example, if the system 1300 is utilized to raise the height of the deck, or if the system 1300 performs a deck 110 leveling sequence the substantially raises the vertical height of the deck 110, the controller 1302 may command the actuator 1114 to raise or lower the motor 118 such that the propeller 1102 is at sufficient depth within the water for ideal propulsion as the boat is banking in the water via raising or lower of the pontoons 102,104,106 as described herein. The controller 1302 may be programmed to activate actuators for a predetermined/known amount of time that will position the pontoons into a known position corresponding with the amount of actuation time. The controller 1302 may be programmed to sense/detect velocity of the boat in the water, and the program may cause controller to adjust pontoons to a predetermined position based on boat velocity (e.g., as the boat slows down, the controller causes the pontoons to extend or retract).

In this manner, if there is uneven weight distribution on the deck 110 such that there is a downward slope or slant on one side of the deck 110, the level sensor 1306 will be able to measure that imbalance and the controller 1302 will send signals to the appropriate actuators 204 to extend or retract the associated pontoons to balance/level the deck 110. For example, if the sensor 1304 measures that the deck 110 is sloped from the port to the starboard side, the controller 1302 may cause activate the actuator 204 on the starboard side pontoon 102 to extend the starboard side pontoon 102 further into the water and create additional buoyant force to raise the starboard side of the deck 110 (and/or the controller 1302 may cause activate the actuator 204 on the port side pontoon 104 to retract the port side pontoon 102); and in these examples, the controller 1302 may cause the actuator 1114 to raise or lower the motor 118 to ensure the propeller 1102 is sufficiently within the water for adequate propulsion. The controller 1302 may run in an automatic mode where it automatically actuates the actuators 204 to extend and/or retract the various pontoons until the deck is level, or the operator may manually actuate the actuators 204 to extend/retract the pontoons until the deck 110 is level. For example, a visual level sensor may be provided such that the operator knows when the deck 110 is substantially level, and/or the system 1300 may provide an indication (e.g., audible and/or visual) to the operator that the deck 110 is substantially level.

The sensor 1304 may be a multi-axis digital sensor that reads orientation of the planar deck 110 data in two or more axes. In some embodiments, the multi-axis digital sensor reads orientation data in three or more axes. In some embodiments, the sensor 1304 can be one of a 3-axis gyroscope or a 3-axis accelerometer. In some embodiments, the sensor 1304 can be a 6-axis digital sensor. The 6-axis digital sensor can include a 3-axis gyroscope and 3-axis accelerometer and a processor for interpreting motion data from the gyroscope and accelerometer. Using data from the gyroscope and accelerometer, the attitude (e.g., pitch, roll, or other relative metrics) of the structure can be calculated, and the accelerometer can be used to determine the rate of change of the attitude. Attitude and rate of change can be measured in reference to any point, line, or plane pre-defined or selected while in progress.

With these arrangements, the leveling controller 1302 and associated systems can be programmable to allow for customization. Included in such leveling systems are memory, temperature adjustments, and directional inputs. The accelerometer can be programmable, and in embodiments includes ranges of, for example, ±2 g, ±4 g, ±8 g, and ±16 g. The 6-axis digital sensor can further include on-chip 16-bit. ADCs, programmable digital filters, a precision clock with small drift (e.g., 1% or less across a temperature range such as −40° C. to 85° C.), an embedded temperature sensor, and programmable interrupts. The sensor can further include I2C and SPI serial interfaces, a VDD operating range of 1.71 to 3.6V, and a separate digital IO supply, VDDIO from 1.7V to 3.6V. Sensor communication can occur with registers using, e.g, I2C at 400 kHz or SPI at 1 MHz. In alternative or complementary embodiments, the sensor and interrupt registers may be read using SPI at 20 MHz. Due to the mobile application, the sensor can also be shock-resistant (e.g., supporting 10,000 g shock reliability).

Systems and methods herein can also include security features. Such features can include security codes having lock-out functionality that lock the system down in a level position (in a fully static position or allowing automatic re-leveling but no other activity) to prevent tampering with the watercraft level, theft, et cetera.

The controller 1302 may have various communication ports (wired and/or wireless), one or more processors 1306, memory 1308 (RAM and/or storage), clocks or timers, motors, display devices, and other components and systems typically provided in the operator area 126 of the boat 100. While embodiments described herein relate at times to leveling assemblies or techniques in a pontoon boat, one of ordinary skill in the art will recognize such are readily adaptable to other water based leveling applications and may be utilized with any suitable water craft for the purpose of leveling the deck thereof when floating in the water.

Using information from the level sensor 1304, the controller 1302 modifies the extension/retraction distances of the pontoons 102,104,106 and rates of extension/retraction to respond to boat 100 dynamics and deck 110 attitude. The rate may either increase or decrease speeds based upon a rate of change of boat dynamics or deck attitude. Still further, the rate of extension/retraction may increase or decrease speeds, or even pause, based upon additional factors such as noise or scale factor. Additional modifications may include retracting an actuator to re-balance or redistribute a load or load component in a more desirable manner. The sensitivity of the level sensor 1304 and controller 1302 can be calibrated. The sample rate of the sensor 1302 can be constant or dynamic depending on user input (e.g., user dictates rate or rates) or operational context (e.g., initial leveling versus re-leveling, amount of tilt). The controller 1302 can limit the speed at which pontoons 102,104,106 extend/retract, in order to control the amount of angular adjustment in a time period. In alternative or complementary embodiments, the controller 1302 can cause one or more actuators to accelerate faster than the standard limited rate to correct for a possible error in operation (e.g., causing too steep of a slope on the deck 110).

The controller 1302 can additionally estimate noise at the sensor 1304. In an embodiment, noise can be estimated after pontoon movement has ceased and the system has settled. In further embodiments, the controller 1302 can pause or delay any later actuator actuation until a static period has passed permitting multiple sensor measurements with the deck 110 and controller 1302 constantly oriented. In this fashion, noise estimates can be developed from the variance of successive sensor 1304 readings during the static period.

The controller 1302 can also change actuator drive rates dynamically to control the tilt rate based upon inputs other than tilt angle. For example, if the amount of over or undershoot measured is beyond a specific threshold the drive rate will be decreased. "Level Stop" readings can be part of the adaptive process that indicates whether further changes are necessary for the next level cycle (e.g., whether stop point accuracy can be further improved). The controller 1302 can employ adaptive filtering to maximize signal stability based on rate of angular change and estimated signal noise. Through adaptive filtering, controller response to sensor data can be automatically changed depending on at least conditions observed.

As mentioned above, the deck 100 may comprise an assembly of materials/members. FIGS. 14A-14D illustrate an exemplary deck assembly 1400 utilizable with pontoon actuation mechanisms described herein, according to on or more embodiments. In the illustrated examples, the deck assembly 1400 includes a layer of decking material 1402 and a frame 1404 attached to a bottom surface 1406 of the deck material 1402. The deck material 1402 defines an upper surface (of shown) of the boat 100. The frame 1404 may comprise a plurality of structural members. Here, for example, the frame 1404 includes a plurality of laterally extending cross-members 1410 extending a width of the deck and a plurality of longitudinally extending members 1412. Here, the are three longitudinally extending members 14012 positioned at an interior (or central) region of the bottom surface 1406, but additional longitudinally extending members 1412 may be provided outward therefrom along the sides and/or more or less than three longitudinally extending members 14012 maybe provided in the central region. Also in the illustrated example, the frame 1404 includes a peripheral extending support 1414 extending around the peripheral edge of the deck material 1402.

Figure 14A:
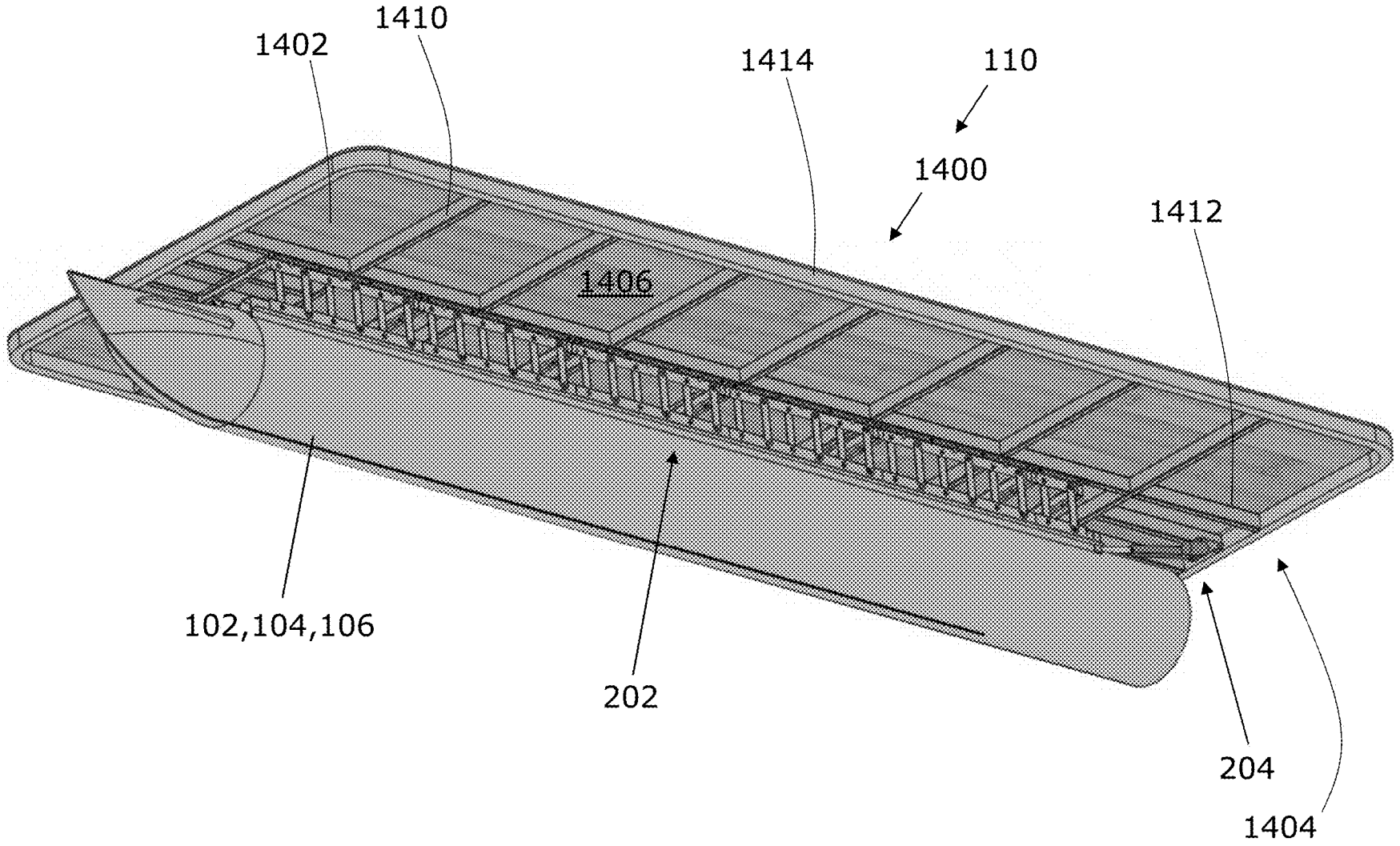
FIGS. 14A-14D illustrate an exemplary deck assembly utilizable with the boat of FIG. 1.
Figure 14B:
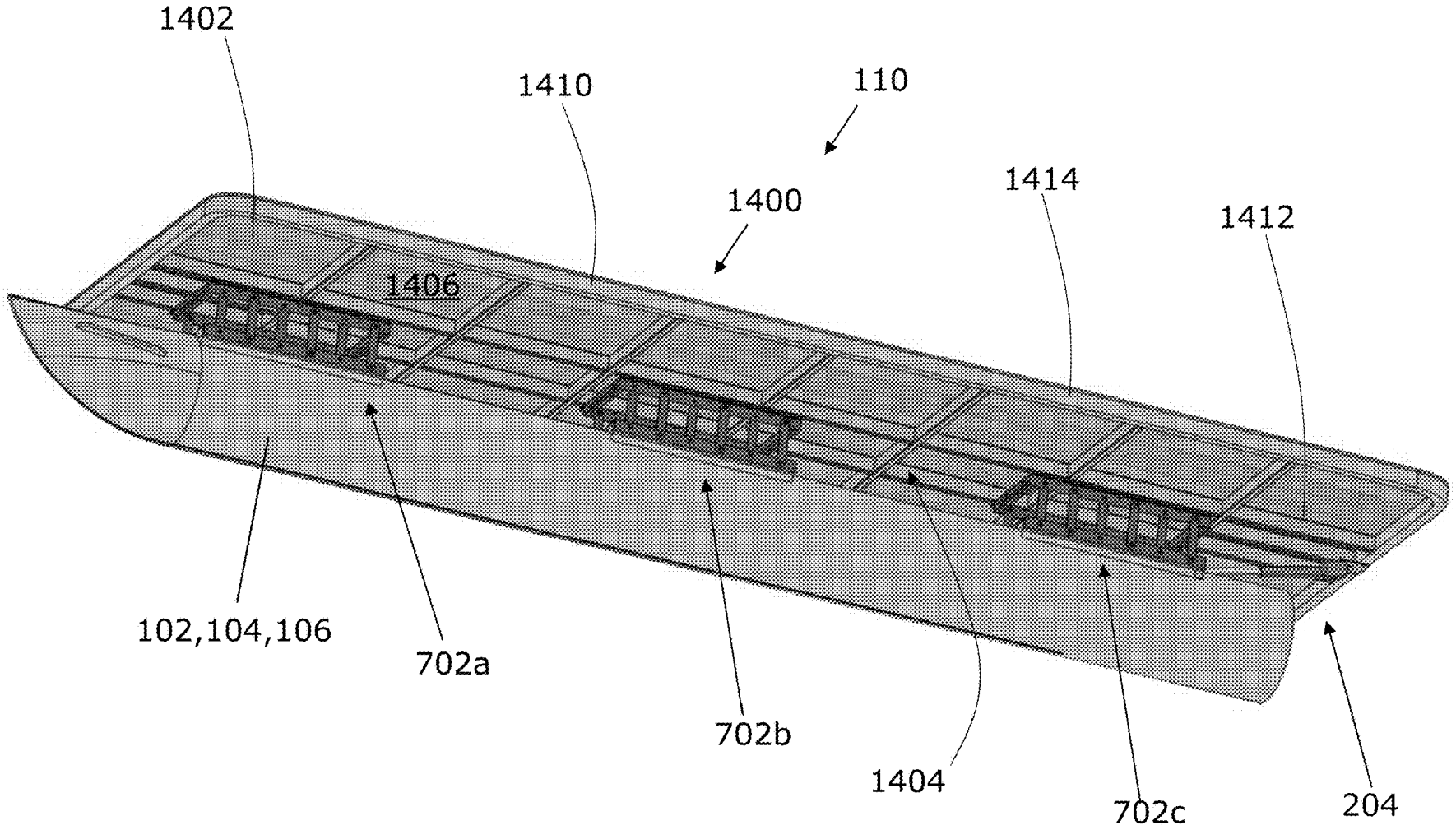
Figure 14C:
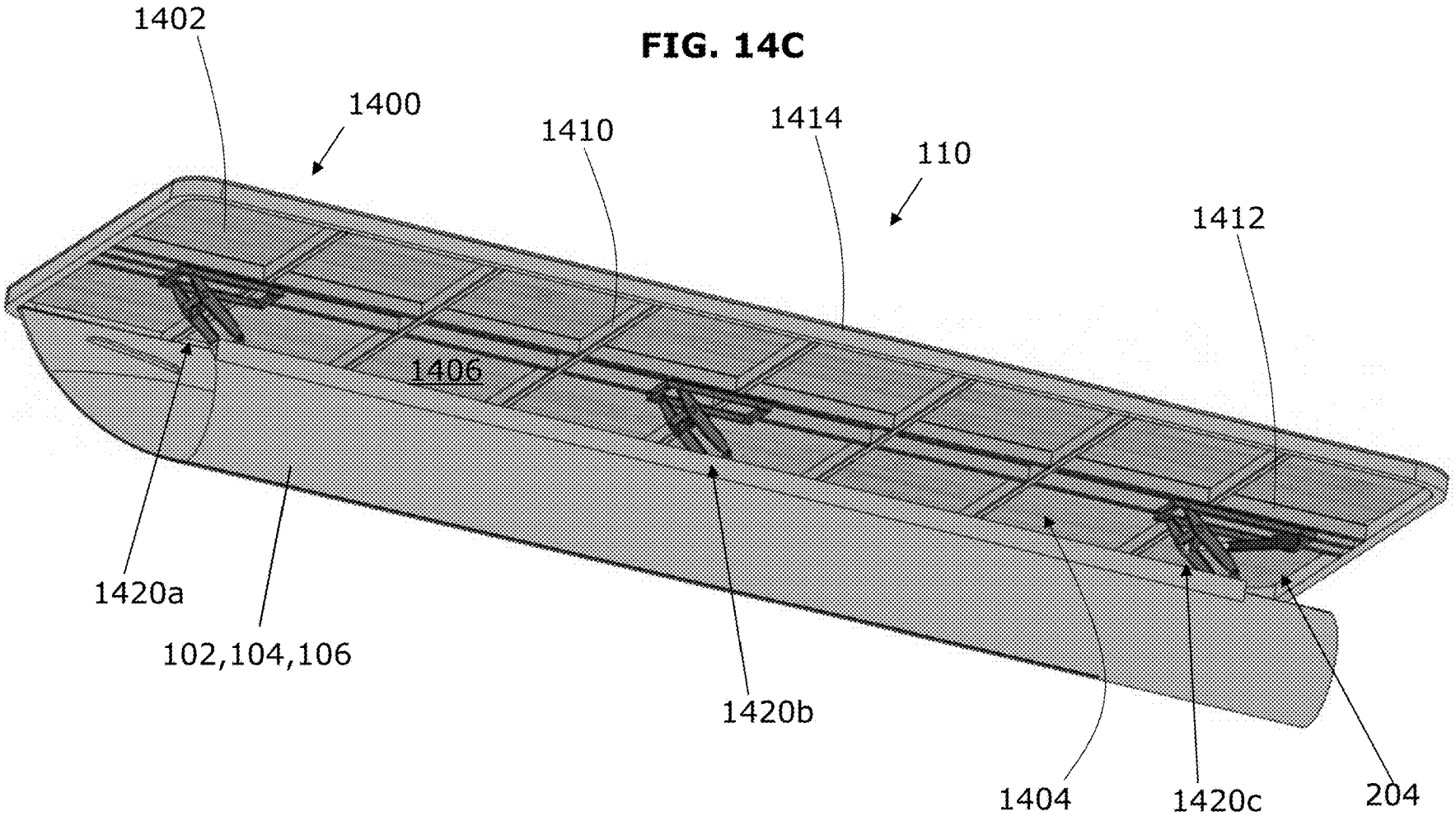
Figure 14D:
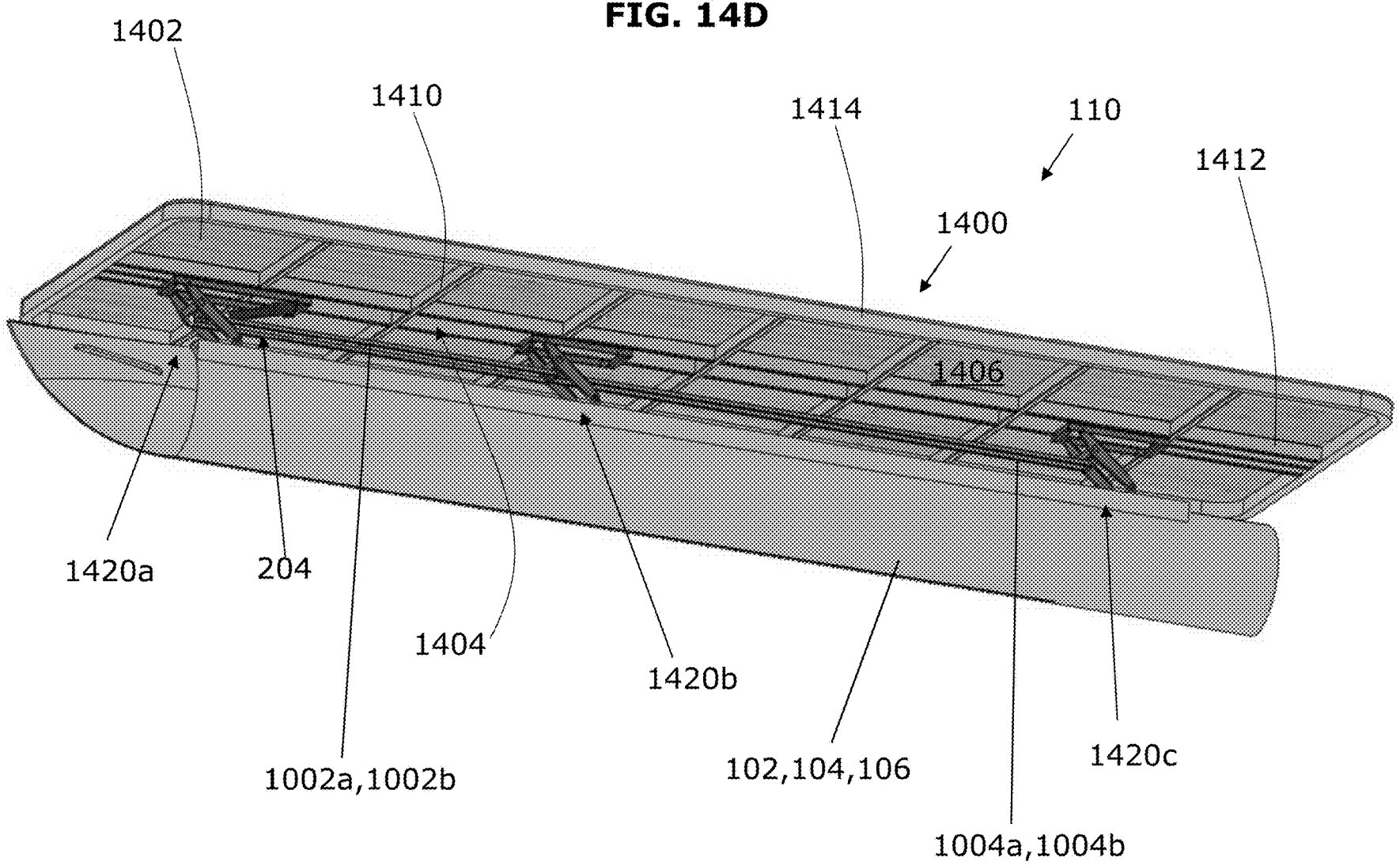

In FIG. 14A, the linkage assembly 202 is utilized to movably couple the pontoon 102,104,106 to the deck assembly 1400, and the linkage assembly 202 is an individual assembly for each pontoon and extends a substantial longitudinal length of its respective pontoon. Here, the actuator 204 is attached to the frame 1404, for example, to cross-members 1410, longitudinal members 1412, and/or peripheral members 1414; however, it may be attached elsewhere relative to the linkage assembly as described herein. In FIG. 14B, discrete linkage segments 702*a*,702*b*,702*c* are utilized to movably couple the pontoon 102,104,106 to the deck assembly 1400. Here, the actuator 204 is attached to the frame 1404, for example, to cross-members 1410, longitudinal members 1412, and/or peripheral members 1414; however, it may be attached elsewhere relative to the linkage assembly segments as described herein. In FIGS. 14C and 14D, a plurality of discrete swing arm link pairs 1420*a*, 1420*b*,1420*c*, as described above, are utilized to movably couple the pontoon 102,104,106 to the deck assembly 1400. In FIG. 14C, the actuator 204 is provided at the stern end of the deck assembly 1400 to power the stern end swing arm assembly 1420*c*; however, the actuator 204 may instead be provided at either or both of the other swing arm assemblies 1420*a*,1420*b* in addition to or instead of as illustrated. In FIG. 14D, the actuator 204 is provide at the aft end swing arm assembly 1420*a* and coupling members/rods 1002,1004 are utilized to transmit power (i.e., "time") the other two swing arm link pairs 1420*b*,1420*c* with the powered swing arm link pair 1420*a*. However, the actuator 204 may be provided to power either of the other two swing arm link pairs 1420*b*,1420*c*, with a mechanical and/or electrical timing provided to "time" that powered swing arm link pair to the remaining unpowered swing arm link pairs.

FIGS. 14A-14D illustrate different exemplary pontoon positioning assemblies/systems configured to move the pontoons 102,104,104 between extended and retracted positions. While the illustrated pontoon positioning assemblies/systems have different link assembly configurations, they are each configured to swing the pontoon in the fore and aft direction. In particular, the pontoon positioning assemblies/systems may swing the pontoon 102,104,104 towards the stern of the boat and upward, into a retracted position where the pontoon 102,104,104 is tucked up next to the bottom surface 1406 of the deck material 1402, and the pontoon positioning assemblies/systems may swing the pontoon 102,104,104 downward and towards the bow of the boat, into an extended position where the pontoon 102,104,104 relatively more distant from the bottom surface 1406 of the deck material 1402. However, the pontoon positioning assemblies/systems may be differently configured, for example, to swing the pontoon 102,104,104 towards the bow of the boat and upward, into a retracted position where the pontoon 102,104,104 is tucked up next to the bottom surface 1406 of the deck material 1402, and the pontoon positioning assemblies/systems may swing the pontoon 102,104,104 downward and towards the stern of the boat, into an extended position where the pontoon 102,104,104 relatively more distant from the bottom surface 1406 of the deck material 1402.

As disclosed herein are pontoon positioning assemblies/systems configured to pivot or rotate the pontoons and/or vertically translate at least a portion of the pontoon. FIGS. 15A-15D illustrate another exemplary pontoon positioning system 1500, according to one or more embodiments of the present disclosure.

In the illustrated example, the pontoon positioning system 1500 includes a pivot assembly 1502 and an actuator assembly 1504. The pivot and actuator assemblies 1502,1504 are each attached to the frame 1404 of the deck assembly 1400 (e.g., on cross-members 1410, longitudinal members 1412, and/or peripheral members 1414). In some examples, a plate (not shown) is mounted on the frame 1404 and the pivot and actuator assemblies 1502,1504 are each mounted on the same or separate plates. Accordingly, the pivot and actuator assemblies 1502,1504 movably couple the pontoon 102,104, 106 to the deck 110. However, while other embodiments of the pontoon positioning assemblies/systems described herein are configured to swing the pontoon 102,104,106, the pontoon positioning system 1500 is configured to rotate or pivot the pontoon 102,104,106 about an axis.

Figure 15A:
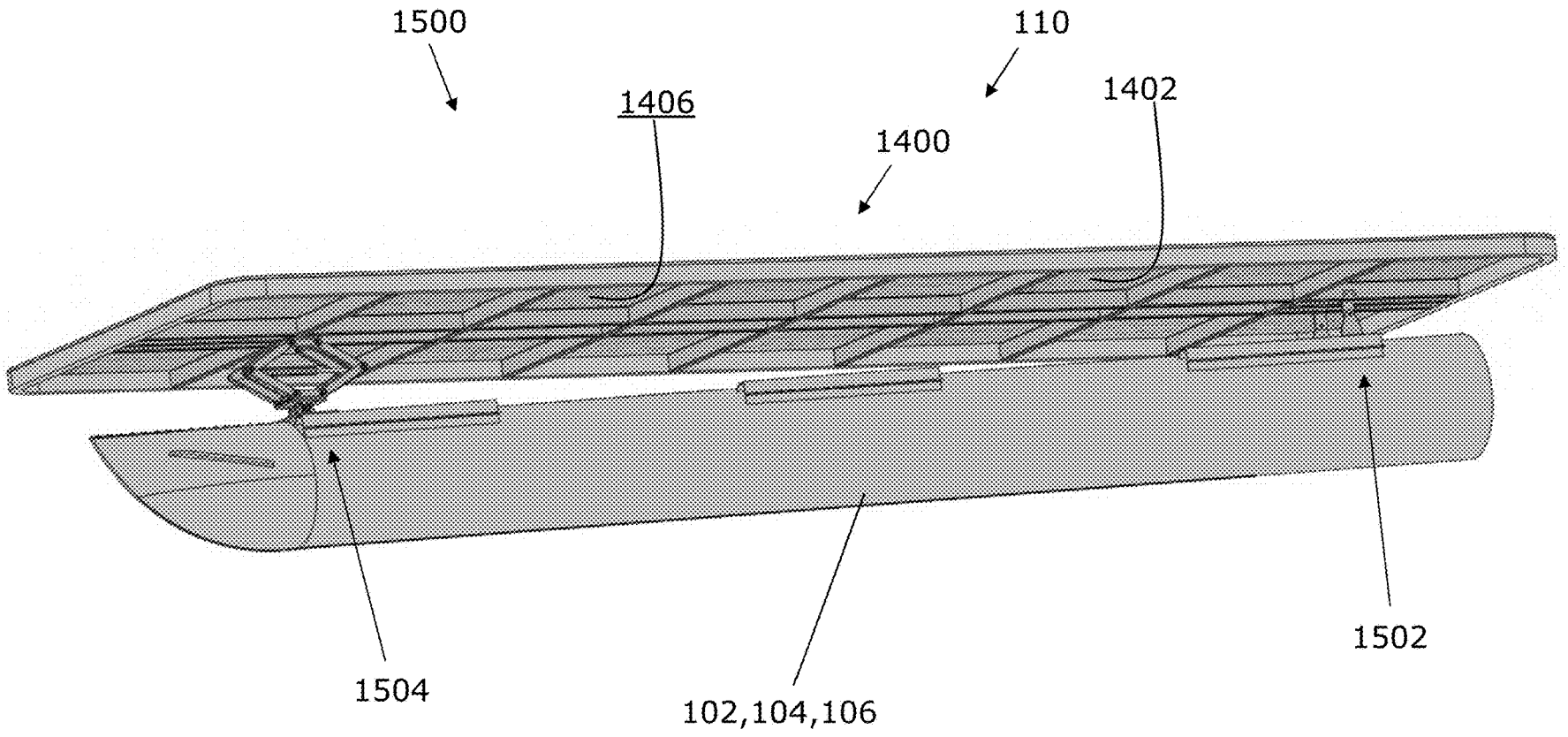
FIGS. 15A-15E illustrate another alternate pontoon positioning assembly/mechanism utilizable with the boat of FIG. 1.
Figure 15B:
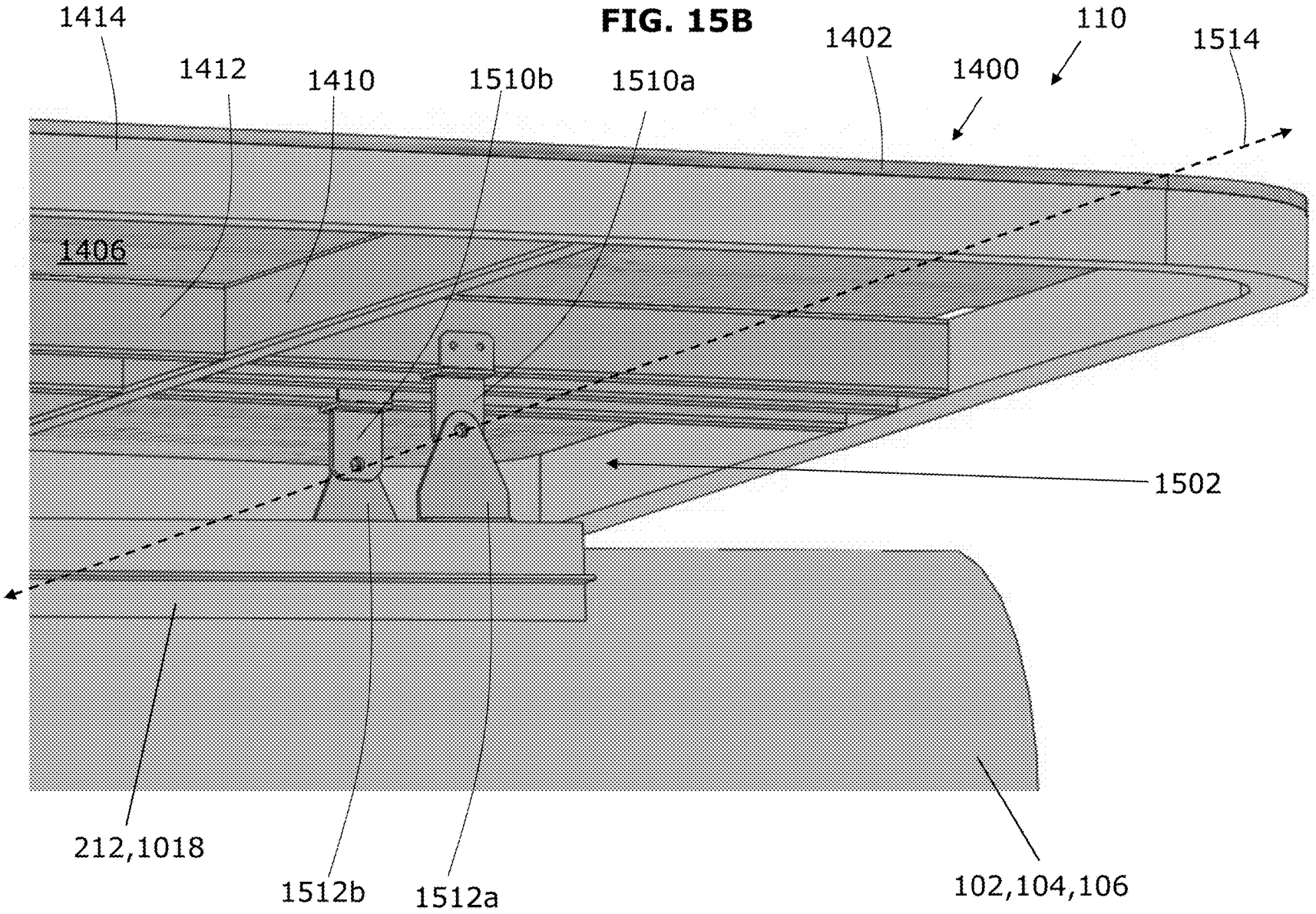

FIG. 15B illustrates an exemplary pivot assembly 1502, according to one or more examples. In the illustrated example, the pivot assembly 1502 includes a pair of upper members 1510*a*,1510*b* and a pair of lower members 1512*a*, 1512*b*. The upper members 1510*a*,1510*b* are mounted to the frame 1404 of the deck assembly 1400, for example, the upper members 1510*a*,1510*b* may have a bracket/flange end configured to be mounted/joined on the longitudinal members 1412 (or a plate provided on the frame 1404). The lower members 1512*a*,1512*b* are mounted to the frame 212 of the pontoons 102,104,106, for example, the lower members 1512*a*,1512*b* may have a bracket/flange end configured to be mounted/joined on the corner segments 1018 secured to the sides of the round pontoon 102,104,10. The upper members 1510*a*,1510 and the lower members 1512*a*,1512*b* are rotatably coupled together so as to be rotatable relative to each other about an axis 1514. For example, the upper members 1510*a*,1510 and the lower members 1512*a*,1512*b* may be pinned together so as to be rotatable about a pin extending along the axis 1514. In this manner, when the pivot assembly 1502 is joined to the deck 110 and the pontoon 102,104,106, the pontoon 102,104,106 will be movable relative to the deck 110 about the axis 1514.

Figure 15C:
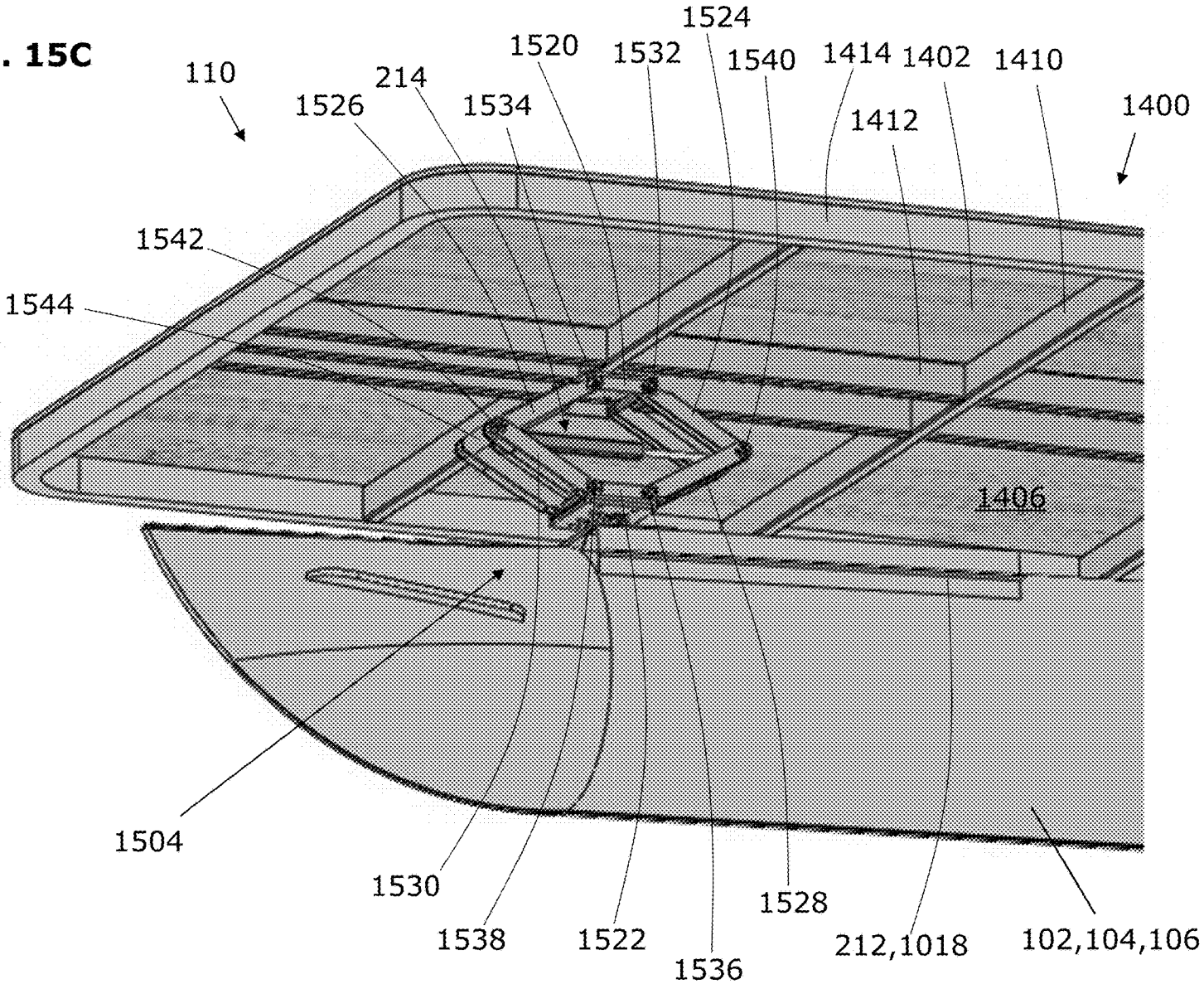
Figure 15D:
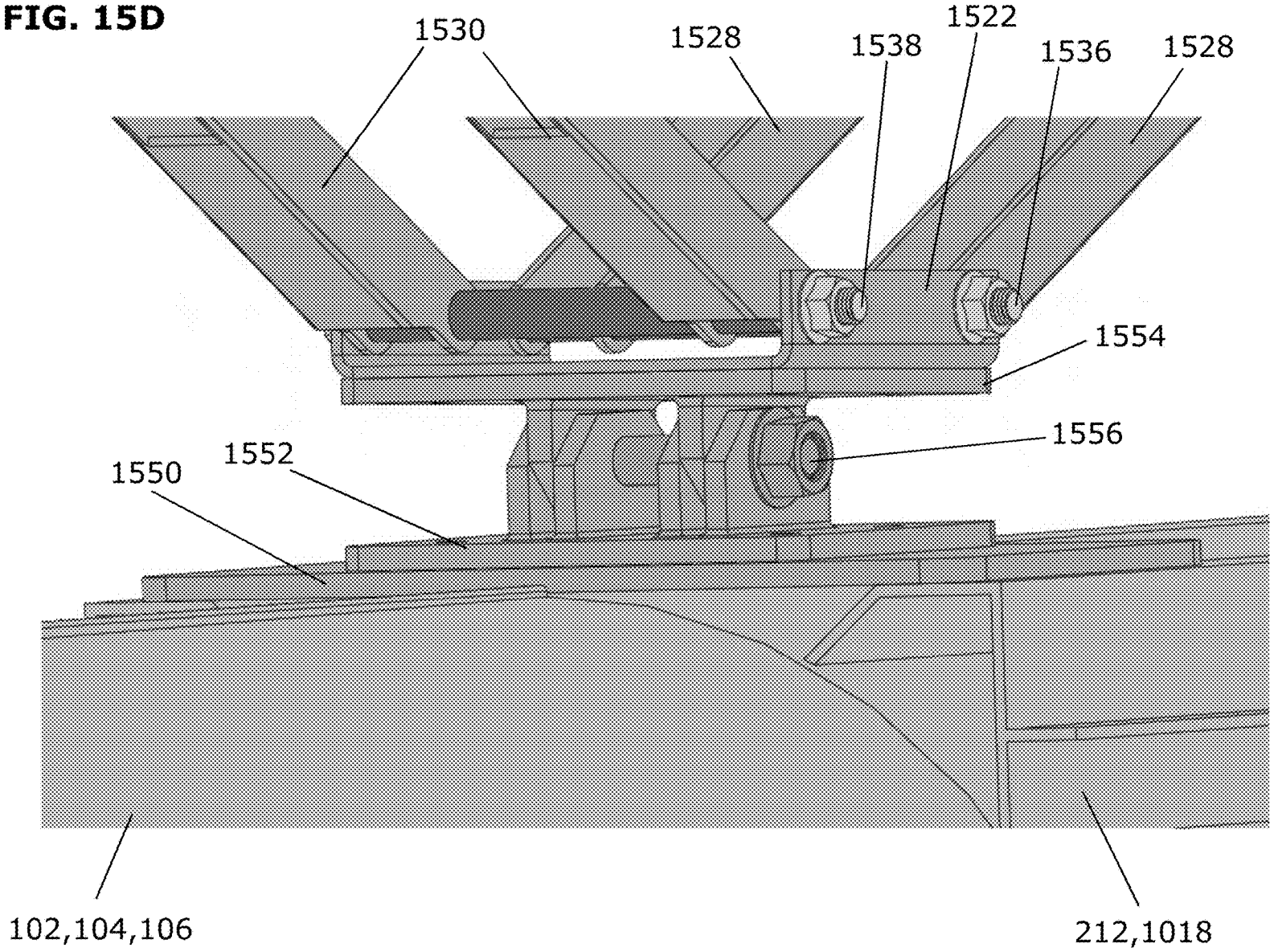
Figure 15E:
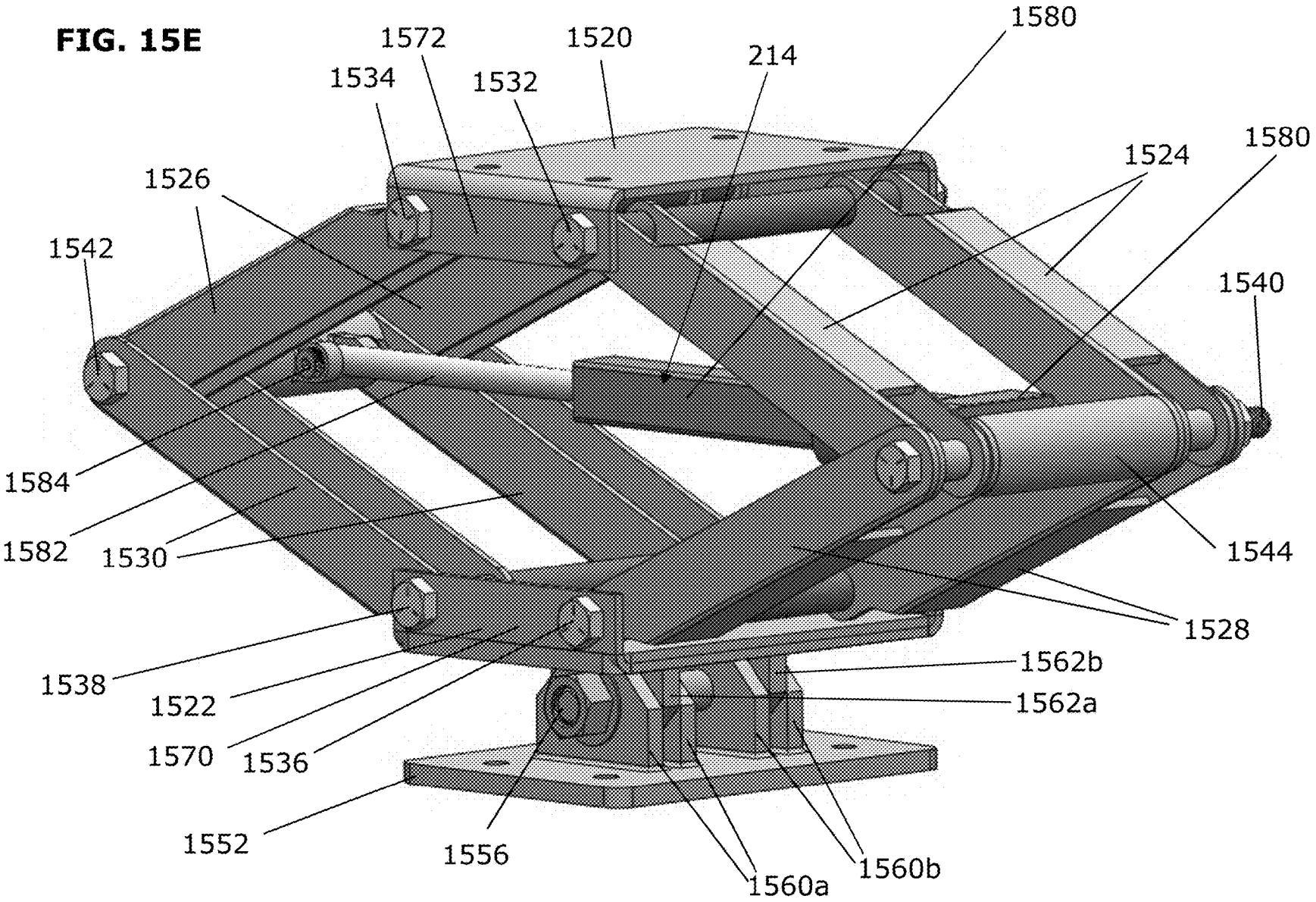

FIGS. 15C-15E illustrate an exemplary actuator assembly 1504, according to one or more examples. In the illustrated example, the actuator assembly 1504 is provided at the bow end of the boat 100, with the pivot assembly 1502 provided at the stern end; however, in other embodiments, the actuator assembly 1504 may be provided at the stern end of the boat 100 and the pivot assembly 1502 may be provided at the bow end, or a pair of the actuator assemblies 1504 may be provided at the both the bow end and the stern end of the boat 100.

In the illustrated example, the actuator assembly 1504 is configured as a scissor linkage assembly comprising a top bracket 1520, a bottom bracket 1522, a pair of first upper arms 1524, a pair of second upper arms 1526, a pair of first lower arms 1528, and a pair of second lower arms 1530. The top bracket 1520 is attached to the frame 1404 of the deck 110, for example, on the cross-members 1410 and/or the longitudinal members 1412. In addition, the bottom bracket 1522 is pivotly attached to the pontoon 102,104,106 as described below.

The first and second upper arms 1524,1526 are rotatably connected to the top bracket 1520, and the first and second lower arms 1528,1530 are rotatably connected to the lower bracket 1522. In particular, the first pair of upper arms 1524 are coupled to the top bracket 1520 via a first pin 1532, such that the first pair of upper arms 1524 may rotate relative to the top bracket 1520 about an axis defined by the first pin 1532; the second pair of upper arms 1526 are coupled to the top bracket 1520 via a second pin 1534, such that the second pair of upper arms 1526 may rotate relative to the top bracket 1520 about an axis defined by the second pin 1534; the first pair of lower arms 1528 are coupled to the bottom bracket 1522 via a first pin 1536, such that the first pair of lower arms 1528 may rotate relative to the lower bracket 1522 about an axis defined by the first pin 1536; and the second pair of lower arms 1530 are coupled to the bottom bracket 1522 via a second pin 1538, such that the second pair of lower arms 1530 may rotate relative to the lower bracket 1522 about an axis defined by the second pin 1538.

The pair of first upper arms 1524 are rotatably connected to the pair of first lower arms 1528 via a first pin 1540 and the pair of second upper arms 1526 are rotatably connected to the pair of second lower arms 1530 via a second pin 1542. Thus, the pair of first upper arms 1524 and the pair of first lower arms 1528 may rotate relative to each other about an axis defined by the first pin 1540. Also, the pair of second upper arms 1526 and the pair of second lower arms 1530 may rotate relative to each other about an axis defined by the second pin 1542. In the illustrated example, a sleeve 1544 is provided over the pins 1540,1542.

The actuator 214 is provided to actuate the scissor linkage and thereby increase or decrease the distance between the top and bottom brackets 1520,1522 (i.e., vertically extend or retract). In particular, the actuator 214 may be provided within the scissor linkage to expand the upper and lower arms outwards, to thereby decrease the distance between the upper and lower brackets 1520,1522 (i.e., and vertically retract the pontoon), or to pull the upper and lower arms inward towards each other, to thereby increase the distance between the upper and lower brackets 1520,1522 (i.e., and vertically extend the pontoon). In the illustrated example, a motor side of the actuator 214 is rotatably attached to the sleeve 1544 provided between the pair of second upper arms 1526 and the pair of second lower arms 1538, and a drive rod of the actuator 214 which extends from its motor side is rotatably attached to the sleeve 1544 provided between the pair of first upper arms 1524 and the pair of first lower arms 1528. In this manner, the actuator 214 applies a drive force at the pins 1540,142 to articulate the scissor linkage and thereby push the brackets 1520,1522 apart from each other (i.e., vertically extend the pontoon) or pull the brackets 1520,1522 closer together (i.e., vertically retract the pontoon).

FIGS. 15D-15E illustrate an example of how the actuator assembly 1504 may be pivotly attached to the pontoon 102,104,106. In the illustrated example, a mounting plate 1550 is joined on top of the pontoon 102,104,106; and, in particular, the mounting plate 1550 is attached on the corner segments 1018. Here, the actuator assembly 1504 also includes a pontoon side bracket 1552 mounted on the plate 1550 and a scissor side bracket 1554 mounted to the lower bracket 1522. The pontoon side bracket 1552 and the scissor side bracket 1554 are rotatably connected to each other via a pin 1556. In particular, the pontoon side bracket 1552 has two pairs of upwardly extending flanges, and the scissor side bracket 1554 has two downwardly extending flanges, where the first of the downwardly extending flanges of scissor side bracket 1554 is received between the first pair of upwardly extending flanges of the pontoon side bracket 1554 and the second of the downwardly extending flanges of scissor side bracket 1554 is received between the second pair of upwardly extending flanges of the pontoon side bracket 1554. The pin 1556 then extends through corresponding bores in the upwardly extending flanges and the downwardly extending flanges. Thus, the pontoon side bracket 1552 and the scissor side bracket 1554 may rotate relative to each other about an axis defined by the pin 1556.

FIG. 15E illustrates an alternate example of the actuator assembly 1504. In the illustrated example, the pontoon side bracket 1552 has two pairs of brackets 1560*a*,1560*b*, and the lower bracket 1520 includes a first and second foot 1562*a*, 1562 arranged to be received within a corresponding on eof the brackets 1560*a*,1560*b*. The brackets 1560*a*,1560*b* and corresponding feet 1562*a*,1562*b* have corresponding/aligned bores through which the pin 1556 is received to permit relative rotation about the axis of the pin 1556. The lower bracket 1522 also has a pair of opposing side walls 1570 with bores through which the pins 1536,1538 may be provided to rotatably couple the first and second pair of lower scissor links 1528,1530. Similarly, the upper bracket 1520 also has a pair of opposing side walls 1572 with bores through which the pins 1532,1533 may be provided to rotatably couple the first and second pair of upper scissor links 1524,1536.

The actuator 214 includes a motor or actuation side 1580 which is rotatably connected to the sleeve 1544 via a pin (not illustrated) such that the motor side 1580 may rotate relative to the sleeve 1544 about an axis defined by the pin (not shown). Also, the actuator 214 includes a drive rode 1582 extending from the motor side 1580, wherein the motor side 1580 is configured to drive (extend or retract) the drive rod 1582. Here, the drive rod 1582 is also rotatably connected to the opposite sleeve 1544 via a pin 1584 such that drive rod 1582 may rotate relative to the opposite sleeve 1544 about an axis defined by the pin 1584.

In other examples, the pontoon 102,104,106 may be movably coupled to the deck 110 via a pair of actuator assemblies 1502 (i.e., a bow end actuator assembly 1502 and a stern end actuator assembly 1502, and optionally one or more middle actuator assemblies 1502). In such examples, the pontoon positioning system is configured to vertically translate/move the pontoon 102,104,106 via articulation of the scissor linkages Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

The use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A pontoon positioning assembly, comprising:

at least one pontoon supporting a deck that extends in a substantially horizontal plane;

a link assembly coupling the deck to the at least one pontoon, wherein the link assembly is configured to permit movement of the at least one pontoon in a plane substantially vertical to the deck from a retracted position to an extended position, where the at least one pontoon is moved further from an underside of the deck, and wherein the link assembly comprises:

a longitudinally extending upper frame attached to an underside of deck, a longitudinally extending lower frame attached to the at least one pontoon, and a plurality of links extending therebetween and rotatably interconnecting the upper frame and lower frame; and an actuator provided to position the at least one pontoon between the retracted position and the extended position.

2. The pontoon positioning assembly of claim 1, wherein the link assembly comprises two or more discrete linkage segments.

3. The pontoon positioning assembly of claim 2, wherein the actuator drives a first of the two or more discrete linkage segments.

4. The pontoon positioning assembly of claim 3, further comprising a coupling member connecting the two or more discrete linkage segments together and transmitting power from the first of the two or more discrete linkage segments to one or more remaining discrete linkage segments.

5. The pontoon positioning assembly of claim 2, wherein the actuator comprises two or more actuators, wherein a first of the two or more actuators drives a first of the two or more discrete linkage segments and a second of the two or more actuators drives a second of the two or more discrete linkage segments.

6. The pontoon positioning assembly of claim 5, wherein two or more actuators are electronically synchronized.

7. The pontoon positioning assembly of claim 2, wherein the two or more discrete linkage segments includes a bow end linkage segment, a stern end linkage segment, and a middle linkage segment between the bow end and stern end linkage segment.

8. The pontoon positioning assembly of claim 7, wherein the actuator drives the bow end linkage segment; or the actuator drives the stern end linkage segment; or the actuator comprises two or more actuators, wherein a first of the two or more actuators drives the bow end linkage segment and a second of the two or more actuators drives the stern end linkage segment.

9. The pontoon positioning assembly of claim 1, wherein the actuator causes extension or retraction of the pontoon based on data indicative of an attitude of the deck.

10. The pontoon positioning assembly of claim 9, wherein the data is captured via a sensor configured to monitor the attitude of the deck and transmit the data to a controller configured to cause extension or retraction of the pontoon based on the data.

11. The pontoon positioning assembly of claim 1, further comprising a switch configured to control activation of the actuator, wherein activation of the switch extends or retracts the at least one pontoon associated with the actuator.

12. A pontoon positioning assembly, comprising:

at least one pontoon supporting a deck;

a link assembly coupling the deck to the at least one pontoon, wherein the link assembly is configured to permit movement of the at least one pontoon relative to the deck from a retracted position to an extended position, where the at least one pontoon is moved further from an underside of the deck; and an actuator provided to position the at least one pontoon between the retracted position and the extended position, wherein the link assembly is a scissor link assembly configured to permit vertical extension or retraction of the associated pontoon.

13. The pontoon positioning assembly of claim 12, wherein the associated pontoon is pivotally attached to the deck at a stern end and the scissor link assembly coupled the associated pontoon to the deck at a bow end, such that the associated pontoon may pivot about an axis upon actuation of the actuator.

14. A boat having a deck supported by a port side pontoon, a starboard side pontoon and a middle pontoon, the middle pontoon arranged between the port side pontoon and the starboard side pontoon, the boat comprising:

a middle pontoon positioning assembly comprising:

a link assembly coupling the deck to the middle pontoon, wherein the link assembly is configured to permit movement of the middle pontoon relative to the deck from a retracted position, where the middle pontoon is proximate to an underside of the deck, to an extended position, where the middle pontoon is moved further from the underside; and an actuator provided to position the middle pontoon between the retracted position and the extended position.

15. The boat according to claim 14, further comprising:

(i) a starboard side pontoon positioning assembly comprising:

a link assembly coupling the deck to the starboard side pontoon, wherein the link assembly is configured to permit movement of the starboard side pontoon relative to the deck from a retracted position, where the starboard side pontoon is proximate to an underside of the deck, to an extended position, where the starboard side pontoon is moved further from the underside, and an actuator provided to position the starboard side pontoon between the retracted position and the extended position; and (ii) a port side pontoon positioning assembly comprising:

a link assembly coupling the deck to the port side pontoon, wherein the link assembly is configured to permit movement of the port side pontoon relative to the deck from a retracted position, where the port side pontoon is proximate to an underside of the deck, to an extended position, where the port side pontoon is moved further from the underside, and an actuator provided to position the port side pontoon between the retracted position and the extended position.

16. The boat according to claim 14, further comprising: a leveling control system having a controller and a level sensor configured to detect an attitude of the deck, the controller in communication with the actuator and cause actuation of the actuator to extend or retract the middle pontoon, based on data received from the level sensor indicative of the deck attitude.

17. The boat of claim 16, wherein the controller is configured to adjust position of the middle pontoon to thereby orient the deck in a desired attitude.

* * * * *